US007073885B2

(12) United States Patent
Yonekubo et al.

(10) Patent No.: US 7,073,885 B2
(45) Date of Patent: Jul. 11, 2006

(54) LIQUID JETTING APPARATUS

(75) Inventors: Shuji Yonekubo, Nagano-Ken (JP); Ryoichi Tanaka, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 10/790,036

(22) Filed: Mar. 2, 2004

(65) Prior Publication Data

US 2004/0165020 A1 Aug. 26, 2004

Related U.S. Application Data

(63) Continuation of application No. 10/144,766, filed on May 15, 2002, now Pat. No. 6,742,859.

(30) Foreign Application Priority Data

May 16, 2001 (JP) ..... 2001-146447
Aug. 29, 2001 (JP) ..... 2001-259801

(51) Int. Cl.
*B41J 2/165* (2006.01)

(52) U.S. Cl. ..... 347/27; 347/9

(58) Field of Classification Search ..... 347/27, 347/9, 11, 20, 22, 29, 19, 65, 68, 70
See application file for complete search history.

(56) References Cited

U.S. PATENT DOCUMENTS

| | | | |
|---|---|---|---|
| 5,541,628 | A | 7/1996 | Chang et al. |
| 6,234,604 | B1 | 5/2001 | Kawakami et al. |
| 6,276,773 | B1 | 8/2001 | Takizawa |
| 6,386,664 | B1 | 5/2002 | Hosono et al. |
| 6,467,865 | B1 | 10/2002 | Iwamura et al. |
| 2002/0012017 | A1 | 1/2002 | Yonekubo |
| 2002/0149634 | A1 | 10/2002 | Fuji et al. |

FOREIGN PATENT DOCUMENTS

| | | | |
|---|---|---|---|
| EP | 0 782 924 | A1 | 7/1997 |
| EP | 0 788 882 | A2 | 8/1997 |
| EP | 1 000 742 | A2 | 5/2000 |
| JP | 03164258 | A | 7/1991 |
| JP | 04078541 | A | 3/1992 |
| JP | 04-219254 | | 8/1992 |
| JP | 10-095132 | | 4/1998 |
| JP | 10-250064 | | 9/1998 |
| JP | 11-192727 | | 7/1999 |
| JP | 2000-085125 | | 3/2000 |
| JP | 2000-117993 | | 4/2000 |
| JP | 2000-233518 | | 8/2000 |
| JP | 2001-260369 | | 9/2001 |
| WO | WO 90/13431 | | 11/1990 |

*Primary Examiner*—Manish Shah
*Assistant Examiner*—Leonard Liang
(74) *Attorney, Agent, or Firm*—Sughrue Mion, PLLC

(57) ABSTRACT

The liquid jetting apparatus includes a head member having a nozzle, a supporting member that that can support a medium, a scanning mechanism that can cause the head member to relatively move with respect to the medium, and a liquid jetting unit that can jet liquid from the nozzle. An area storing unit stores a relative area to which liquid can be jetted from the nozzle while the head member is caused to relatively move by the scanning mechanism. An out-of-jetting micro-vibrating-area setting unit can set out-of-jetting micro-vibrating areas before and after the relative area. A micro-vibrating unit causes liquid, in the nozzle to minutely vibrate. An out-of-jetting micro-vibrating controlling unit causes the micro-vibrating unit to operate when the head member is located in the out-of-jetting micro-vibrating areas, while the head member is caused to relatively move by the scanning mechanism, based on the out-of-jetting micro-vibrating areas and head-position information.

8 Claims, 12 Drawing Sheets

LIQUID JETTING APPARATUS

This is a continuation of application Ser. No. 10/144,766 filed May 15, 2002 now U.S. Pat. No. 6,742,859 the disclosure of which is incorporated herein by reference.

FIELD OF THE INVENTION

This invention relates to a liquid jetting apparatus having a head member capable of jetting liquid from nozzles, such as an ink-jet recording apparatus having a recording head capable of jetting ink from nozzles to form dots on a recording medium. In particular, this invention is related to a liquid jetting apparatus which can prevent viscosity of liquid in nozzles from increasing.

BACKGROUND OF THE INVENTION

An ink-jet recording apparatus such as an ink-jet printer or an ink-jet plotter has a recording head that is movable along a main scanning direction. The recording head has nozzles capable of jetting ink. For example, the nozzles are communicated to pressure chambers which can expand and contract respectively. In the case, the ink in the nozzles can be jetted by expanding and contracting of the pressure chambers.

On the other hand, the ink-jet recording apparatus is adapted to feed a recording medium such as a paper along a subordinate scanning direction, which is perpendicular to the main scanning direction. Thus, the nozzles of the recording head can jet ink to form an image or a character on the recording medium in cooperation with moving the recording head and the recording medium according to recording data.

The ink in the nozzles of the recording head is exposed to air. Thus, solvent of the ink such as water may gradually evaporate to increase a viscosity of the ink in the nozzles. In the case, quality of printed (recorded) images may deteriorate because the ink having a great viscosity may be jetted toward a direction deviated from a normal direction.

To prevent the viscosity of the ink in the nozzles from increasing, some measures have been proposed. One of the measures is to cause a meniscus of the ink to minutely vibrate to stir the ink. The meniscus means a free surface of the ink exposed at an opening of the nozzle.

For stirring the ink, the meniscus may be vibrated to a jetting direction of the ink and to a contracting direction opposed to the jetting direction by turns in such a manner that the ink may not be jetted. The vibration of the meniscus can be also carried out by expanding and contracting of the pressure chambers. Owing to the vibration of the meniscus, the ink at the opening of the nozzle may be stirred to prevent the viscosity of the ink from increasing.

The stirring of the ink may be carried out during a recording operation. For example, the stirring may be carried out while a carriage carrying the recording head is being accelerated after starting a main scanning, or while a recording operation for a line is being carried out. In the stirring while the carriage is being accelerated, a micro-vibrating operating signal for micro vibrating is supplied to the recording head to cause all menisci in the nozzles to minutely vibrate. In the stirring while the recording operation is being carried out, a pulse signal for micro vibrating is generated from a jetting operating signal for jetting ink, and the pulse signal is supplied to the recording head. Thus, the ink in the nozzles not in the recording (jetting) operation may be stirred.

In addition, Japanese Patent Laid-Open Publication No. 2000-21507 has described that it is effective to cause menisci of ink in nozzles to minutely vibrate during a predetermined time from a suitable timing just before jetting a drop of the ink or from a suitable timing just before jetting a drop-of the-ink till another suitable timing just before jetting a drop of the ink.

Japanese Patent Laid-open Publication No. 2000-21507 has also proposed a pre-printing micro-vibrating operation just before jetting a drop of the ink. In addition, Japanese Patent Laid-Open Publication No. 2000-21507 has disclosed that an out-of-printing micro-vibrating operation can be performed further before the pre-printing micro-vibrating operation.

However, if an ink whose viscosity tends to increase is used (for example, a kind of pigment ink or a kind of high-density dye ink), solvent of the ink may easily evaporate to increase a viscosity of the ink, even for a short time between a completion of a main scanning operation and a start of a next main scanning operation. In the case, it is possible that the state wherein the viscosity of the ink has been increased may not be dispelled sufficiently by means of the out-of-printing micro-vibrating operation or the pre-printing micro-vibrating operation after starting the next main scanning operation.

SUMMARY OF THE INVENTION

The object of this invention is to solve the above problems, that is, to provide a liquid jetting apparatus that can prevent a viscosity of liquid from increasing, even if a liquid whose viscosity tends to increase is used, such as an ink-jet recording apparatus.

In order to achieve the object, the invention is a liquid jetting apparatus comprising: a head member having a nozzle; a supporting member that can support a medium onto which liquid is to be jetted; a scanning mechanism that can cause the head member to relatively move with respect to the medium; a liquid jetting unit that can jet liquid from the nozzle; an area storing unit that stores a relative area to which liquid can be jetted from the nozzle while the head member is caused to relatively move by the scanning mechanism; an out-of-jetting micro-vibrating-area setting unit that can set out-of-jetting micro-vibrating areas before and after the relative area to which liquid can be jetted from the nozzle, based on the relative area to which liquid can be jetted from the nozzle; a scanning-position-information outputting unit capable of outputting head-position information that represents a relative position of the head member while the head member is caused to relatively move by the scanning mechanism; a micro-vibrating unit that can cause liquid in the nozzle to minutely vibrate; and an out-of-jetting micro-vibrating controlling unit that can cause the micro-vibrating unit to operate when the head member is located in the out-of-jetting micro-vibrating areas, while the head member is caused to relatively move by the scanning mechanism, based on the out-of-jetting micro-vibrating areas and the head-position information.

According to the above feature, since the out-of-jetting micro-vibrating areas are set before and after the relative area to which liquid can be jetted from the nozzle, it can be effectively prevented that a viscosity of the liquid increases between a completion of a scanning operation and a start of a next scanning operation.

Alternatively, the invention is a liquid jetting apparatus comprising: a head member having a nozzle; a supporting member that can support a medium onto which liquid is to be jetted; a scanning mechanism that can cause the head member to relatively move with respect to the medium; a liquid jetting unit that can jet liquid from the nozzle; an out-of-jetting micro-vibrating-area setting unit that can set out-of-jetting micro-vibrating areas before and after a liquid-jetting area to which liquid is to be jetted from the nozzle while the head member is caused to relatively move by the scanning mechanism, based on jetting data; a scanning-position-information outputting unit capable of outputting head-position information that represents a relative position of the head member while the head member is caused to relatively move by the scanning mechanism; a micro-vibrating unit that can cause liquid in the nozzle to minutely vibrate; and an out-of-jetting micro-vibrating controlling unit that can cause the micro-vibrating unit to operate when the head member is located in the out-of-jetting micro-vibrating areas, while the head member is caused to relatively move by the scanning mechanism, based on the out-of-jetting micro-vibrating areas and the head-position information.

According to the above feature, since the out-of-jetting micro-vibrating areas are set before and after the liquid-jetting area to which liquid is to be jetted from the nozzle while the head member is caused to relatively move by the scanning mechanism based on jetting data, it can be effectively prevented that a viscosity of the liquid increases between a completion of a scanning operation and a start of a next scanning operation.

The scanning mechanism may includes: a main-scanning mechanism that can cause the head member to relatively move with respect to the medium in a main scanning direction; and a sub-scanning mechanism that can cause the head member to relatively move with respect to the medium in a sub-scanning direction perpendicular to the main scanning direction. In the case, it is preferable that the out-of-jetting micro-vibrating-area setting unit includes: an actual-jetting-area calculating part that can obtain a jetting-starting position and a jetting-terminating position for each main scanning movement of the head member, based on jetting data; and an area-setting main part that can set out-of-jetting micro-vibrating areas based on the jetting-starting position and the jetting-terminating position. In the case, for example, the area-setting main part can set out-of-jetting micro-vibrating areas in such a manner that the out-of-jetting micro-vibrating areas are an area before the jetting-starting position and an area after the jetting-terminating position for each main scanning movement of the head member.

Alternatively, it is preferable that the out-of-jetting micro-vibrating-area setting unit further includes a second-area-setting main part that can set a pre-jetting micro-vibrating area based on the jetting-starting position, and that the area-setting main part is adapted to set out-of-jetting micro-vibrating areas in such a manner that the out-of-jetting micro-vibrating areas are an area before the pre-jetting micro-vibrating area and an area after the jetting-terminating position for each main scanning movement of the head member. In the case, the out-of-jetting micro-vibrating operation and the pre-jetting micro-vibrating operation can be separately controlled.

In addition, preferably, the out-of-jetting micro-vibrating controlling unit causes the micro-vibrating unit to operate from a completion of a main scanning movement of the head member to a start of a next main scanning movement thereof as well. That is, preferably, the out-of-jetting micro-vibrating operation can be performed during a sub-scanning movement as well. Thus, it can be prevented more surely that the viscosity of the liquid increases.

Herein, if liquid jetting operations are performed during both of two-way scanning movements i.e. forward and rearward scanning movements, it is preferable that the out-of-jetting micro-vibrating operation is suspended during a signal-switching operation for switching directions of the scanning movements.

That is, if a liquid-jetting controlling unit that can give a operating signal to the liquid jetting unit is provided, the scanning mechanism is adapted to cause the head member to relatively move with respect to the medium in forward and backward directions, and the liquid-jetting controlling unit is adapted to give a first operating signal to the liquid jetting unit while the head member is caused to relatively move with respect to the medium in a forward direction and to give a second operating signal to the liquid jetting unit while the head member is caused to relatively move with respect to the medium in a rearward direction, it is preferable that the out-of-jetting micro-vibrating controlling unit is adapted to cause the micro-vibrating unit to operate, from a completion of causing the head member to relatively move with respect to the medium in the forward direction until a start of switching operation of the operating signals by the liquid-jetting controlling unit and from a completion of the switching operation until a start of causing the head member to relatively rove with respect to the medium in the rearward direction.

According to the above one or more features, compared to the conventional art, the out-of-jetting micro-vibrating operation is performed for a longer time. Thus, the micro-vibrating unit, for example a piezoelectric vibrating member such as PZT, may be deteriorated earlier.

Thus, preferably, a signal generating unit that can generate an out-of-jetting micro-vibrating signal as a periodical signal having a predetermined waveform is provided; the out-of-jetting micro-vibrating controlling unit is adapted to cause the micro-vibrating unit to operate based on the out-of-jetting micro-vibrating signal; a measuring unit that can measure a continuous operating time of the micro-vibrating unit by the out-of-jetting micro-vibrating controlling unit is provided; a standard-time storing unit that stores a predetermined standard time is provided; and a signal-generating controlling unit that can compare the continuous operating time and the standard time, and that can cause the signal generating unit to change the out-of-jetting micro-vibrating signal based on result of the comparison is provided.

In the case, dependently on the continuous operating time of the micro-vibrating unit, for example, strength of the out-of-jetting micro-vibrating operation can be lowered, so that deterioration of the micro-vibrating unit can be restrained.

In a concrete example, for example, the signal-generating controlling unit may be adapted to cause the signal generating unit to change the out-of-jetting micro-vibrating signal in such a manner that a frequency of the out-of-jetting micro-vibrating signal is lowered when the continuous operating time becomes longer than the standard time. Alternatively, the signal-generating controlling unit may be adapted to cause the signal generating unit to change the out-of-jetting micro-vibrating signal in such a manner that an amplitude of the out-of-jetting micro-vibrating signal is lowered when the continuous operating time becomes longer than the standard time.

After the frequency of the out-of-jetting micro-vibrating signal has been lowered by the signal generating unit, preferably, the signal-generating controlling unit is adapted to cause the signal generating unit to change again the out-of-jetting micro-vibrating signal before a liquid-jetting operation in such a manner that the frequency of the out-of-jetting micro-vibrating signal is returned to an original frequency. In addition, after the frequency of the out-of-jetting micro-vibrating signal has been returned to the original frequency by the signal generating unit, preferably, the out-of-jetting micro-vibrating controlling unit is adapted to cause the micro-vibrating unit to operate based on the out-of-jetting micro-vibrating signal for a predetermined time before the liquid-jetting operation.

Similarly, after the amplitude of the out-of-jetting micro-vibrating signal has been lowered by the signal generating unit, preferably, the signal-generating controlling limit is adapted to cause the signal generating unit to change again the out-of-jetting micro-vibrating signal before a liquid-jetting operation in such a manner that the amplitude of the out-of-jetting micro-vibrating signal is returned to an original amplitude. In addition, after the amplitude of the out-of-jetting micro-vibrating signal has been returned to the original amplitude by the signal generating unit, preferably, the out-of-jetting micro-vibrating controlling unit is adapted to cause the micro-vibrating unit to operate based on the out-of-jetting micro-vibrating signal for a predetermined time before the liquid-jetting operation.

In addition, in general, a capping mechanism that can seal the nozzle may be provided in a relative movable (scanning) area of the head member. In the case, preferably, the out-of-jetting micro-vibrating controlling unit is adapted to cause the micro-vibrating unit to operate during at least a part of time for which the capping mechanism seals the nozzle.

More preferably, the out-of-jetting micro-vibrating controlling unit is adapted to repeat a controlling step of causing the micro-vibrating unit to operate for a first constant time and causing the micro-vibrating unit not to operate for a second constant time while the capping mechanism seals the nozzle.

In the case, further preferably, a history recording unit that records history information about liquid-jetting operations is provided, and a time-changing unit that can change at least one of the first constant time and the second constant time based on the history information about liquid-jetting operations recorded by the history recording unit is provided.

Alternatively, further preferably, an environmental-information obtaining unit that can obtain environmental information around the capping mechanism is provided, and a time-changing unit that can change at least one of the first constant time and the second constant time based on the environmental information obtained by the environmental-information obtaining unit is provided.

In addition, in order to prevent deterioration of the micro-vibrating unit, it is preferable that the signal-generating controlling unit is adapted to cause the signal generating unit to change the out-of-jetting micro-vibrating signal in such a manner that a frequency of the out-of-jetting micro-vibrating signal is lowered while the capping mechanism seals the nozzle. Alternatively, it is preferable that the signal-generating controlling unit is adapted to cause the signal generating unit to change the out-of-jetting micro-vibrating signal in such a manner that an amplitude of the out-of-jetting micro-vibrating signal is lowered while the capping mechanism seals the nozzle.

In addition, the invention is a controlling unit that can control a liquid jetting apparatus including: a head member having a nozzle; a supporting member that can support a medium onto which liquid is to be jetted; a scanning mechanism that can cause the head member to relatively move with respect to the medium; a liquid jetting unit that can jet liquid from the nozzle; a micro-vibrating unit that can cause liquid in the nozzle to minutely vibrate; and a scanning-position-information outputting unit capable of outputting head-position information that represents a relative position of the head member while the head member is caused to relatively move by the scanning mechanism;

the controlling unit comprising: an area storing unit that stores a relative area to which liquid can be jetted from the nozzle while the head member is caused to relatively move by the is scanning mechanism; an out-of-jetting micro-vibrating-area setting unit that can set out-of-jetting micro-vibrating areas before and after the relative area to which liquid can be jetted from the nozzle, based on the relative area to which liquid can be jetted from the nozzle; and an out-of-jetting micro-vibrating controlling unit that can cause the micro-vibrating unit to operate when the head member is located in the out-of-jetting micro-vibrating areas, while the head member is caused to relatively move by the scanning mechanism, based on the out-of-jetting micro-vibrating areas and the head-position information.

In addition, the invention is a controlling unit that can control a liquid jetting apparatus including: a head member having a nozzle a supporting member that can support a medium onto which liquid is to be jetted; a scanning mechanism that can cause the head member to relatively move with respect to the medium; a liquid jetting unit that can jet liquid from the nozzle; a micro-vibrating unit that can cause liquid in the nozzle to minutely vibrate; and a scanning-position-information outputting unit capable of outputting head-position information that represents a relative position of the head member while the head member is caused to relatively move by the scanning mechanism;

the controlling unit comprising: an out-of-jetting micro-vibrating-area setting unit that can set out-of-jetting micro-vibrating areas before and after a liquid-jetting area to which liquid is to be jetted from the nozzle while the head member is caused to relatively move by the scanning mechanism, based on jetting data; and an out-of-jetting micro-vibrating controlling unit that can cause the micro-vibrating unit to operate when the head member is located in the out-of-jetting micro-vibrating areas, while the head member is caused to relatively move by the scanning mechanism, based on the out-of-jetting micro-vibrating areas and the head-position information.

A computer system can materialize the controlling unit or any element of the controlling unit.

This invention includes a storage unit capable of being read by a computer, storing a program for materializing the controlling unit or the element in a computer system.

This invention also includes the program itself for materializing the controlling unit or the element in the computer system.

The storage unit may be not only a substantial object such as a floppy disk or the like, but also a network for transmitting various signals.

BEST MODE FOR CARRYING OUT THE INVENTION

Figure 1:
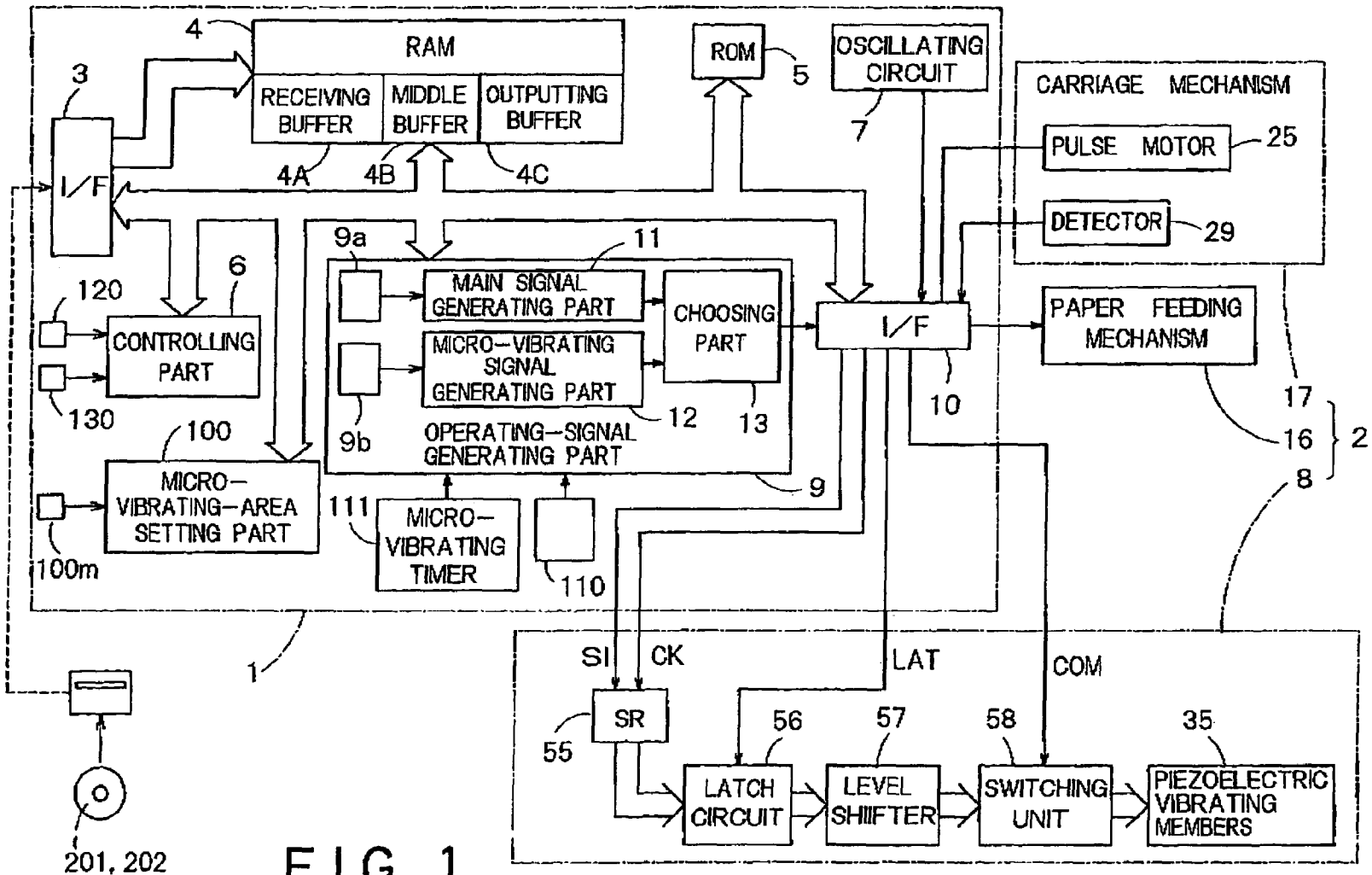
FIG. 1 is a schematic block diagram of an embodiment of the ink-jet recording apparatus according to the invention.

An embodiment of the invention will now be described in more detail with reference to drawings. As shown in FIG. 1, the liquid jetting apparatus of the embodiment is an ink-jet recording printer having a printer controller 1 and a print engine 2.

The printer controller 1 has: an outside interface (outside I/F) 3, a RAM 4 that is able to temporarily store various data, a ROM 5 which stores a controlling program or the like, a controlling part 6 including CPU or the like, an oscillating circuit 7 for generating a clock signal, an operating-signal generating part 9 for generating an operating signal that is to be supplied into a recording head 8, and an inside interface (inside I/F) 10 that is adapted to send the operating signal, dot-pattern-data (bit-map-data) developed according to printing data (recording data) or the like to the print engine 2.

The outside I/F 3 is adapted to receive printing data consisting of character codes, graphic functions, image data or the like from a host computer not shown or the like. In addition, a busy signal (BUSY) or an acknowledge signal (ACK) is adapted to be outputted to the host computer or the like through the outside I/F 3.

The RAM 4 has: a receiving buffer 4A, a middle buffer 4B, an outputting buffer 4C and a work memory not shown. The receiving buffer 4A is adapted to receive the printing data through the outside I/F 3, and temporarily store the printing data. The middle buffer 4B is adapted to store middle-code-data converted from the printing data by the controlling part 6. The outputting buffer 4C is adapted to store dot-pattern-data, which are recording-data obtained by decoding (translating) the middle-code-data. The middle-code-data may be gradation data.

The ROM 5 stores font data, graphic functions or the like in addition to the controlling program (controlling routine) for carrying out various data-processing operations.

The controlling part 6 (an out-of-jetting micro-vibrating controlling unit) is adapted to carry out various controlling operations according to the controlling program stored in the ROM 5. For example, the controlling part 6 reads out the printing data from the receiving buffer 4A, converts the printing data into the middle-code-data, cause the middle buffer 4B to store the middle-code-data. Then, the controlling part 6 analyzes the middle-code-data in the middle buffer 4B and develops (decodes) the middle-code-data into the dot-pattern-data with reference to the font data and the graphic functions or the like stored in the ROM 5. Then, the controlling part 6 carries out necessary decorating operations to the dot-pattern-data, and thereafter causes the outputting buffer 4C to store the dot-pattern-data.

When the dot-pattern-data corresponding to one line recorded by one main scanning of the recording head 8 are obtained, the dot-pattern-data are outputted to the recording head 8 from the outputting buffer 4C through the inside I/F 10 in turn. When the dot-pattern-data corresponding to the one line are outputted from the outputting buffer 4C, the middle-code-data that has been developed are deleted from the middle buffer 4B, and the next developing operation starts for the next middle-code-data.

The operating-signal generating part 9 has: a main signal generating part 11 for generating a jetting operating signal that is used for jetting ink (for recording), a micro-vibrating-signal generating part 12 for generating an out-of-recording micro-vibrating signal and a pre-recording micro-vibrating signal that are used for causing a meniscus 52 (see FIG. 3B) to minutely vibrate so as to stir the ink in the nozzle, and a choosing part 13 that is adapted to be inputted the jetting operating signal from the main signal generating part 11 and the out-of-recording micro-vibrating signal or the pre-recording micro-vibrating signal from the micro-vibrating-signal generating part 12, and to output one of the jetting operating signal, the out-of-recording micro-vibrating signal and the pre-recording micro-vibrating signal to the inside I/F 10.

Herein, the main signal generating part 11 serves as a jetting-operating-signal generating unit, the micro-vibrating-signal generating part 12 serves as a micro-vibrating-signal generating unit, and the choosing part 13 serves as a signal choosing unit.

The operating-signal generating part 9 may consist of logic circuits, or controlling circuits having a CPU, a ROM, a RAM or the like.

The print engine 2 consists of a paper feeding mechanism 16, a carriage mechanism 17 and the recording head 8.

Figure 2A:
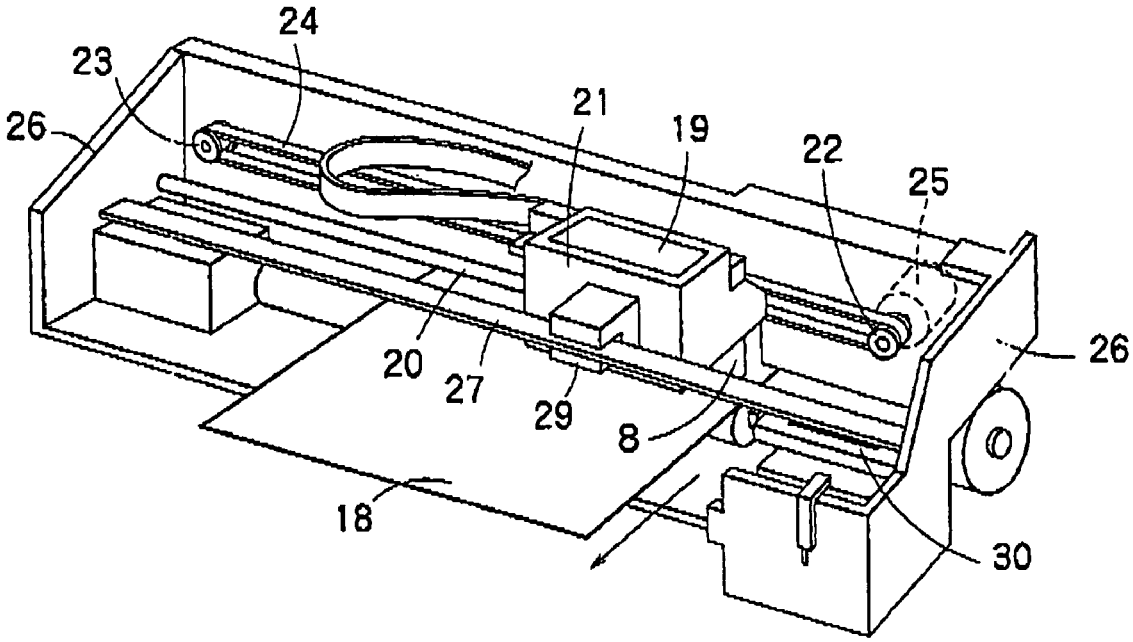
FIG. 2A is a perspective view of the embodiment of the ink-jet recording apparatus shown in FIG. 1.

The paper feeding mechanism 16 consists of a paper feeding motor, a paper feeding roller and so on. As shown in FIG. 2A, a recording paper 18, which is an example of a recording medium, is fed in a subordinate scanning direction in turn by the paper feeding mechanism 16, in cooperation with the scanning operation of the recording head 8.

As shown in FIG. 2A, the carriage mechanism 17 has: a carriage 21 that is slidably mounted on a guiding member 20 and is capable of carrying the recording head 8 and an ink cartridge 19, a timing belt 24 that circulates around a driving pulley 22 and a following pulley 23 and is connected with the carriage 21, a pulse motor 25 for causing the driving pulley 22 to rotate, a linear encoder 27 supported by a printer housing 26 in such a manner that the linear encoder 27 extends in a direction of width of the recording paper 18 (in the main scanning direction), and a slit detector 29 mounted on the carriage 21 and capable of detecting a plurality of slits 28 of the linear encoder 27.

Figure 2B:
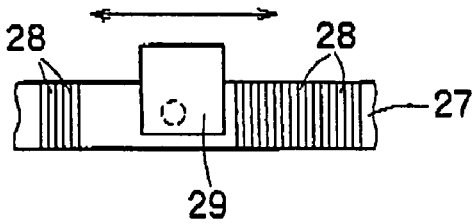
FIGS. 2B and 2C are explanatory views of the linear encoder and the slit detector.
Figure 2C:
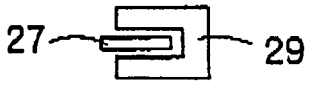

As shown in FIGS. 2B and 2C, the linear encoder 27 of the embodiment consists of a transparent plate. The plurality of slits 28 is formed at pitches of 360 dpi in the linear encoder 27. For example, the slit detector 29 may consist of a photo-interrupter.

According to the carriage mechanism 17 described above, the carriage 21 can reciprocate in the width direction of the recording paper 18 (in the main scanning direction) by driving the pulse motor 25. Thus, the recording head 8 mounted on the carriage 21 can also reciprocate in the main scanning direction. For the movement (reciprocation) of the carriage 21, a standard position as a starting point is set at a side of a home position. The home position means a position where the carriage 21 stands by when the electric power is not supplied, when the scanning operation is not carried out for a long time, or the like. In the embodiment, the home position is located in a right end portion of FIG. 2A.

In the embodiment, a capping mechanism 30 is provided at the home position in order to prevent solvent of ink in nozzles 51 (described below) of the recording head 8 from evaporating.

On the other hand, the standard position is located at a little left position with respect to the home position. In detail, the standard position is located between a right end of the recording paper 18 and the capping mechanism 30.

When the carriage 21 is moved, the slit detector 29 is moved together with the carriage 21. During the movement, the slit detector 29 detects the plurality of slits 28 of the linear encoder 27 in turn, and outputs pulse-like detecting signals each of which corresponds to each of slits 28. The controlling part 6 recognizes a position of the recording head 8 based on the detecting signals from the slit detector 29.

In more detail, the controlling part 6 resets a counting value of a position counter when the carriage 21 is positioned at the standard position. Then, the controlling part 6 receives the pulse-like detecting signals from the slit detector 29 in turn while the carriage 21 is moved. The counting value of the position counter increases by one whenever the controlling part 6 receives one pulse-like signal. Thus, the counting value of the position counter functions as head-position information that represents a position of the carriage 21 i.e. a scanning position of the recording head 8. The position counter may be provided in the work memory (not shown) of the RAM 4. Alternatively, the position counter may be provided separately.

Therefore, the linear encoder 27 and the slit detector 29 function as a scanning-position-information outputting unit. That is, they output information about the position of the recording head 8 (detecting signals) during the main scanning of the carriage 21 (recording head 8). The controlling part 6 and the position counter (RAM 4) function as scanning-position-holding means. That is, they hold the counting value that has been updated according to the detecting signals from the slit detector 29.

Figure 3A:
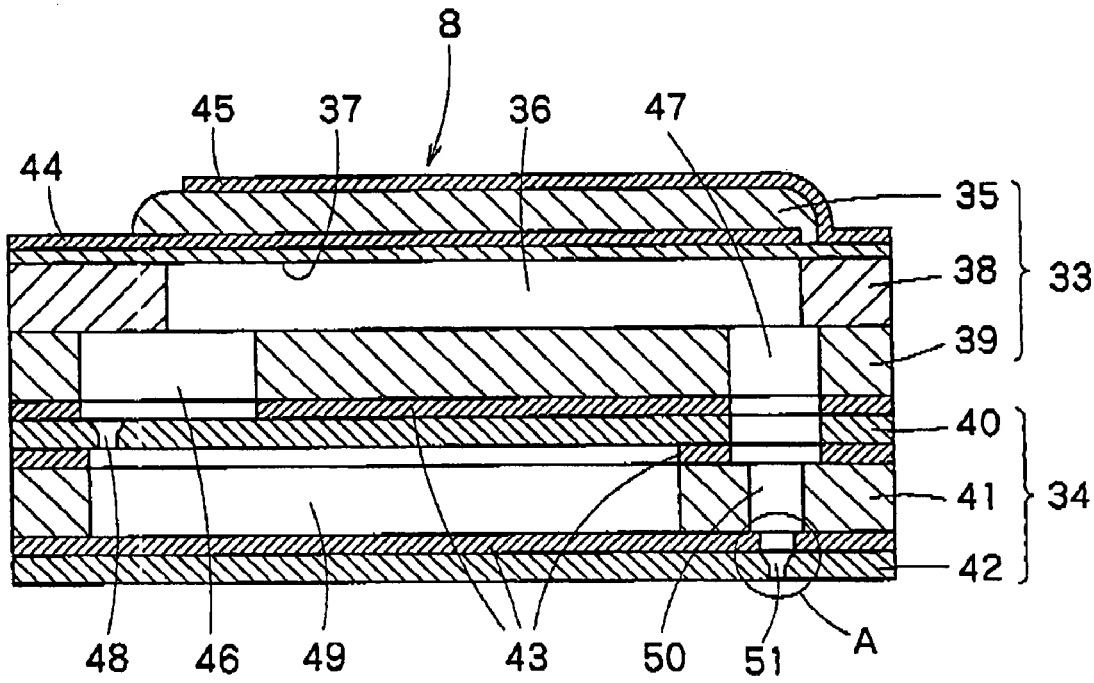
FIG. 3A is a sectional view of the recording head of the ink-jet recording apparatus.

Then, the recording head 8 is explained in more detail. As shown in FIG. 3A, the recording head 8 mainly consists of an actuator unit 33 and an ink-way unit 34. The recording head 8 includes bending-mode piezoelectric vibrating members 35 as pressure generating members.

When electric power is supplied to a bending-mode piezoelectric vibrating member 35, the member 35 contracts to deform a pressure generating chamber 36 in such a manner that a volume of the pressure generating chamber 36 becomes smaller when electric charges are discharged from the bending-mode piezoelectric vibrating member 35, the member 35 expands to deform the pressure generating chamber 36 in such a manner that the volume of the pressure generating chamber 36 returns to an original state thereof.

The actuator unit 33 comprises a first lid 37, a spacer 38, a second lid 39 and piezoelectric vibrating members 35. The ink-way unit 34 comprises an ink-way forming plate 40, an ink-chamber forming plate 41 and a nozzle plate 42. The actuator unit 33 and the ink-way unit 34 are integrated by an adhesive layer 43 to form the recording head 8. The adhesive layer 43 may consist of a thermal welding film or a suitable adhesive material.

The first lid 37 may be an elastic thin plate made of ceramic in general. In the embodiment, the first lid 37 is made of zirconia ($ZrO_2$)having a thickness of about 6 μm. A common electrode 44 for the piezoelectric vibrating members 35 is formed on an upper surface of the first lid 37. The electric vibrating members 35 are integrated on the common electrode 44 respectively. Driving electrodes 45 for the piezoelectric vibrating members 35 are provided on upper surfaces of the piezoelectric vibrating members 35, respectively.

The spacer 38 may be a ceramic plate having penetrating holes that form pressure generating chambers 36 respectively. In the embodiment, the spacer 38 is made of zirconia, and has a thickness of about 100 μm.

The second lid 39 may be a ceramic plate having penetrating holes that form supplying-holes 46 respectively at a left side in FIG. 3A and penetrating holes that form first-nozzle-holes 47 respectively at a right side in FIG. 3A. The second lid 39 may be made of zirconia.

The first lid 37 is arranged on an upper surface of the spacer 38. The second lid 39 is arranged on a lower surface of the spacer 38. That is, the spacer 38 is sandwiched between the first lid 37 and the second lid 39. Each of the first lid 37, the spacer 38 and the second lid 39 is molded into a predetermined shape out of clay-like ceramic. Then, the first lid 37, the spacer 38 and the second lid 39 are layered and integrated by baking.

The ink-way forming plate 40 may be a plate having penetrating holes that form ink-supplying-openings 48 respectively at a left side in FIG. 3A and penetrating holes that form first-nozzle-holes 47 respectively at a right side in FIG. 3A. The ink-chamber forming plate 41 may be a plate having penetrating holes that form an ink chamber 49 at a left and middle side in FIG. 3A and penetrating holes that form second-nozzle-holes 50 respectively at a right side in FIG. 3A. The nozzle plate 42 may be a thin plate having nozzles 51 at a right side in FIG. 3A. The nozzles 51 are arranged at pitches (at intervals) that correspond to a density of forming dots, in a subordinate scanning direction. The number of the nozzles is for example 48. The nozzle plate 42 may be made of stainless steel.

The nozzle plate 42 is arranged on a lower surface of the ink-chamber forming plate 41 via an adhesive layer 43. The ink-way forming plate 40 is arranged on an upper surface of the ink-chamber forming plate 41 via an adhesive layer 43. Thus, the ink-way forming plate 40, the ink-chamber forming plate 41 and the nozzle plate 42 are integrated as the ink-way unit 34.

In the recording head 8 described above, the ink chambers 49 of the ink-way unit 34 are communicated with the supplying-holes 46 of the actuator unit 33 through the ink-supplying-openings 48 respectively. The supplying-holes 46 are communicated with the first-nozzle-holes 47 through the pressure generating chambers 36 respectively.

The nozzles 51 are communicated with the first-nozzle-holes 47 through the second-nozzle-holes 50 respectively. Thus, ink-ways are formed from the ink chamber 49 to the nozzles 51 through the pressure chambers 36 respectively. Ink in the ink cartridge 19 is adapted to be supplied into the ink chambers 49 through ink supplying ways not shown.

The ink can be jetted from the nozzles 51 by changing the volumes of the pressure chambers 36. In more detail, when electric power is supplied to a piezoelectric vibrating member 35, the piezoelectric vibrating member 35 contracts in a direction perpendicular to a direction of the electric field. Then, the first lid 37 is deformed in such a manner that a pressure chamber 36 corresponding to the piezoelectric vibrating member 35 contracts with respect to an original state thereof. On the other hand, when electric charges are discharged from the piezoelectric vibrating member 35, the piezoelectric vibrating member 35 expands in the direction perpendicular to the direction of the electric field. Then, the first lid 37 is deformed in such a manner that the pressure chamber 36 corresponding to the piezoelectric vibrating member 35 expands back to the original state thereof. When the pressure chamber 35 contracts rapidly after the pressure chamber 36 has expanded, a pressure of ink in the pressure chamber 36 increases rapidly. Thus, an ink drop is jetted from the nozzle 51 corresponding to the pressure chamber 36 as shown by an alternate long and short dash line in FIG. 3B.

Figure 3B:
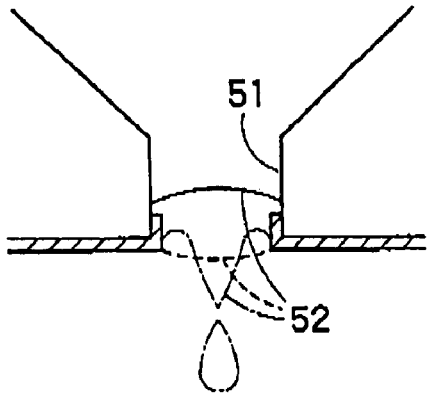
FIG. 3B is an enlarged view of the A portion of the FIG. 3A.

On the other hand, by causing the pressure chamber 36 to expand and contract in such a manner that the ink in the nozzle 51 is not jetted, the ink in the nozzle 51 can be stirred in order to prevent the viscosity of the ink from increasing. In more detail, a meniscus 52 (free surface of the ink exposed at an opening of the nozzle 51) can be caused to minutely vibrate i.e. move to a jetting direction of the ink and to a contracting direction opposed to the jetting direction by turns as shown in FIG. 3B, by causing the pressure chamber 36 to expand and contract in such a manner that the ink is not jetted. Owing to the vibration of the meniscus, the ink at the opening of the nozzle can be stirred in order to prevent the viscosity of the ink from increasing.

Figure 4:
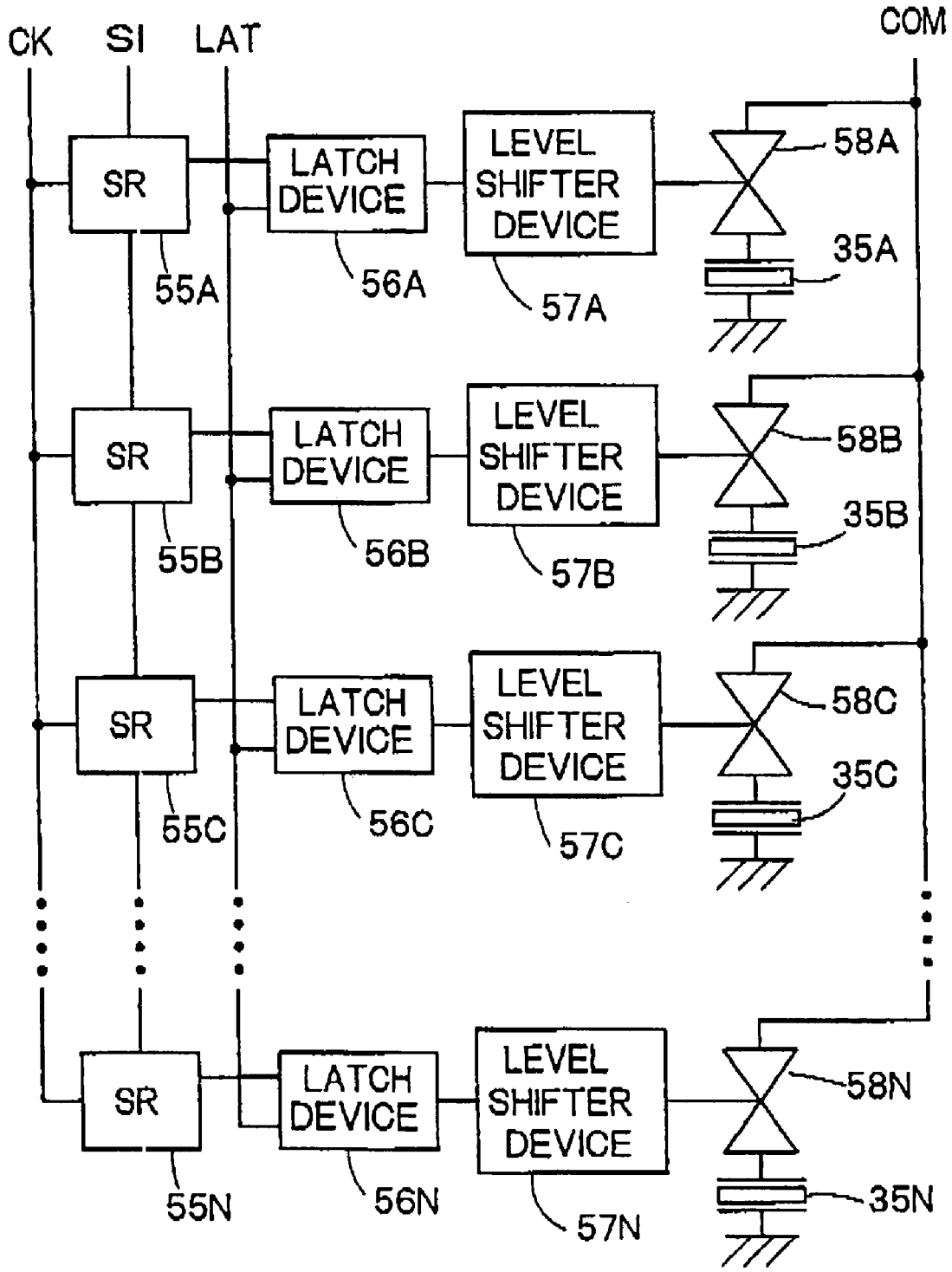
FIG. 4 is a schematic block diagram for explaining an electric structure of the recording head.

Then, an electric structure of the recording head 8 is explained. As shown in FIG. 1, the recording head 8 includes a shift register 55, a latch circuit 56, a level shifter 57 and a switching unit 58 and the piezoelectric vibrating members 35, which are electrically connected in the order. The shift register 55 has a plurality of shift register devices 55A to 55N each of which corresponds to each of the nozzles 51, as shown in FIG. 4. Similarly, the latch circuit 56 has a plurality of latch devices 56A to 56N each of which corresponds to each of the nozzles 51, the level shifter 57 has a plurality of level shifter devices 57A to 57N each of which corresponds to each of the nozzles 51, and the switching unit 58 has a plurality of switching devices 55A to 55N each of which corresponds to each of the nozzles 51. In addition, each of the piezoelectric vibrating members 35 corresponds to each of the nozzles 51. Thus, the piezoelectric vibrating members 35 are also designated as piezoelectric vibrating members 35A to 35N.

The shift register 55, the latch circuit 56, the level shifter 57, the switching unit 58 and the controlling part 6 are adapted to function as operating-pulse supplying means. That is, they can generate an operating pulse (operating-pulse signal) from a jetting operating signal from the operating-signal generating part 9, and output (supply) the operating pulse to the piezoelectric vibrating members 35 of the recording head 8.

In addition, the shift register 55, the latch circuit 56, the level shifter 57, the switching unit 58 and the controlling part 6 are also adapted to function as a micro-vibrating-signal supplying (generating) unit. That is, they can supply an out-of-recording micro-vibrating signal or a pre-recording micro-vibrating signal from the micro-vibrating-signal generating part 12 to the recording head 8 (piezoelectric vibrating members 35). Alternatively, they can generate a mid-recording micro-vibrating signal from a jetting operating signal, and output (supply) the signal to the recording head 8.

Then, a controlling operation for jetting ink is explained. At first, the operating pulse is supplied to the piezoelectric vibrating members 35 as follows. Herein, each of printing data forming the dot-pattern-data corresponds to one dot and consists of a plurality of bits.

In the case, the controlling part 6 transfers in a serial manner and sets in turn data of respective uppermost bits of the units of the printing data (SI) from the outputting buffer 4C to the shift register devices 55A to 55N respectively, synchronously with the clock signal (CK) from the oscillating circuit 7. When the uppermost data of all the units for all the nozzles 51 are set in the shift register devices 55A to 55N, the controlling part 6 outputs latch signals (LAT) to the latch circuit 56 i.e. the latch devices 56A to 56N at a suitable timing. Owing to the latch signals, the latch devices 56A to 56N latch the data set in the shift register devices 55A to 55N respectively. The latched data are supplied to the level shifter 57 i.e. the level shifter devices 57A to 57N respectively. The level shifter 57 is adapted to function as a voltage amplifier.

For example, when the set datum is 1, each of the level shifter devices 57A to 57N boosts the datum to a voltage of several decade volt that can drive the switching unit 58. The boosted (raised) datum is applied to the switching unit 58 i.e. each of the switching devices 58A to 58N. Each of the switching devices 58A to 58N is closed (connected) by the boosted datum. On the other hand, when the set datum is 0, each of the level shifter devices 57A to 57N does not boost the datum.

A jetting operating signal (COM) from the main-signal generating part 11 is applied to each of the switching devices 58A to 58N. When each of the switching devices 58A to 58N is closed, the jetting operating signal is supplied to each of the piezoelectric vibrating members 35A to 35N that are connected to the switching devices 58A to 58N.

After the jetting operating signal has been supplied to the piezoelectric vibrating members based on the uppermost bits, the controlling part 6 transfers in a serial manner and sets data of respective secondly uppermost bits of the units of the printing data (SI) to the shift register devices 55A to 55N respectively. When the second data are set in the shift register devices 55A to 55N, the controlling part 6 outputs latch signals (LAT) to the latch circuit 56 to latch the set data, and the jetting operating signal is supplied to each of the piezoelectric vibrating members 35A to 35N respectively. Thereafter, the similar operations are repeated for from the thirdly uppermost bits to the lowermost bits in the order.

As described above, the printer can control whether to supply the jetting operating signal to the piezoelectric vibrating members 35 base on the printing data. That is, if the printing datum is set to be "1", the jetting operating signal may be supplied to the corresponding piezoelectric vibrating member 35. If the printing datum is set to be "0", the jetting operating signal may not be supplied to the corresponding piezoelectric vibrating member 35. Herein, if a printing datum is "0", the piezoelectric vibrating member 35 holds previous electric charges i.e. a previous voltage.

Thus, a plurality of operating pulses and a mid-recording micro-vibrating signal can be made selectively from one jetting operating signal, when the jetting operating signal is divided into some sections with respect to time and each of the bits of the units of the printing data is set correspondingly to each of the sections of the jetting operating signal. The generated operating pulse or mid-recording micro-vibrating signal may be supplied to each of the piezo electric vibrating members 35. Thus, a meniscus 52 of ink in a nozzle not in a recording operation can be minutely vibrated while another nozzle is in the recording operation. In addition, the plurality of operating pulses corresponding to a plurality of volumes of ink (dot diameters) can be supplied to each of the piezoelectric vibrating members 35 of the recording head 8.

Figure 5:
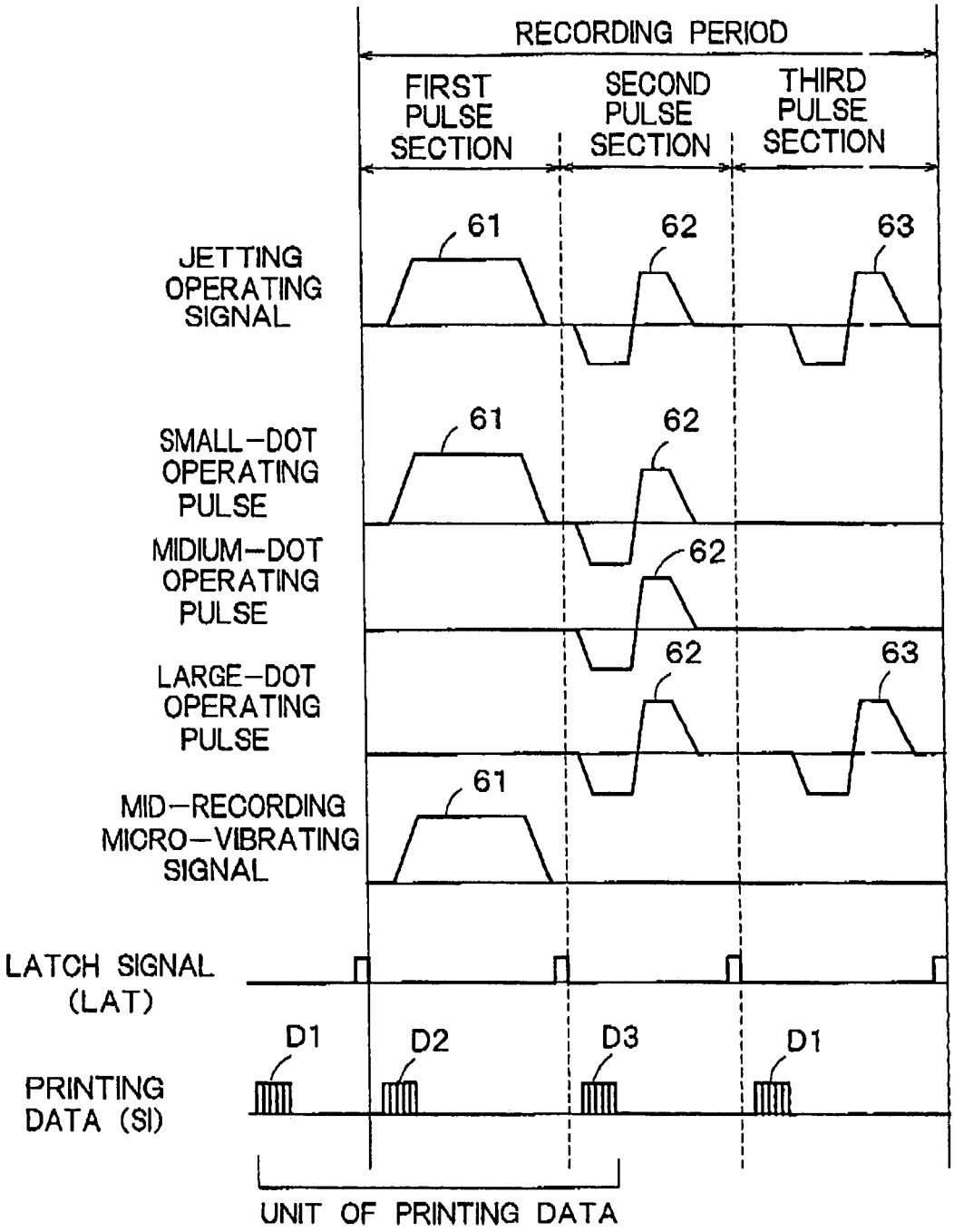
FIG. 5 is an explanatory view of a jetting operating signal and operating pulses generated by the jetting operating signal.

For example, as shown in FIG. 5, the jetting operating signal is divided into a first pulse section 61, a second pulse section 62 and a third pulse section 63. A small-dot operating pulse is generated by the first pulse section 61 and the second pulse section 62. A medium-dot operating pulse is generated by the second pulse section 62 solo. A large-dot operating pulse is generated by the second pulse section 62 and the third pulse section 63. A mid-printing micro-vibrating signal is generated by the first pulse section 61 solo.

The small-dot operating pulse is an operating pulse that can cause a small-sized inkdrop forming a small-sized dot to be jetted. The medium-dot operating pulse is an operating pulse that can cause a medium-sized inkdrop forming a medium-sized dot to be jetted. The large-dot operating pulse is an operating pulse that can cause a large-sized inkdrop forming a large-sized dot to be jetted. The mid-recording micro-vibrating pulse (signal) is an operating pulse that can cause the meniscus 52 of the ink in the nozzle 51 not in the recording operation to minutely vibrate.

When the mid-recording micro-vibrating signal is supplied to the piezoelectric vibrating members 35, as shown in FIG. 3B, the meniscus 52 can be minutely vibrated between a position of a jetting side and a position of a contracting side nearer to the pressure chamber 36. In FIG. 5B, the position of the jetting side is designated by the broken line, and the position of the contracting side is designated by the real line. Owing to the vibration of the meniscus 52, the ink at the opening of the nozzle can be stirred.

In the embodiment, the printing data consist of data of three bits D1, D2 and D3. When D1=1, D2=1 and D3=0 are set, the small-dot operating pulse is adapted to be generated. When D1=0, D2=1 and D3=0 are set, the medium-dot operating pulse is adapted to be generated. When D1=0, D2=1 and D3=1 are set, the large-dot operating pulse is adapted to be generated. When D1=1, D2=0 and D3=0 are set, the mid-recording micro-vibrating pulse is adapted to be generated.

On the other hand, a stirring operation for causing the meniscus 52 to minutely vibrate with the out-of-recording micro-vibrating signal or the pre-recording micro-vibrating signal from the micro-vibrating-signal generating part 12 in order to stir the ink is explained. During the stirring operation, the printing datum is set to be "1" for all the nozzles 51. Thus, a series of the micro-vibrating signals generated by the micro-vibrating-signal generating part 12 is supplied to the piezoelectric vibrating members 35 as it is. Thus, the piezoelectric vibrating members 35 are deformed so that the menisci 52 are minutely vibrated.

Figure 6:
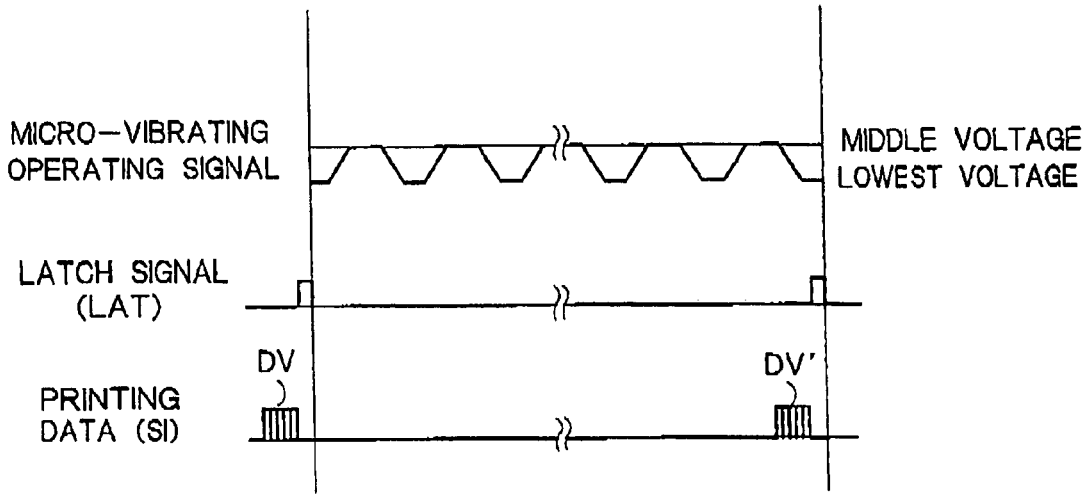
FIG. 6 is an explanatory view of a micro-vibrating operating signal.

The out-of-recording micro-vibrating signal and the pre-recording micro-vibrating signal are usually the same signal. For example, as shown in FIG. 6, the same micro-vibrating signal is formed by a periodical signal serially including a trapezoidal pulse switched between a lowermost potential and a middle potential. When the micro-vibrating signal is supplied to the piezoelectric vibrating members 35, the pressure chambers 36 repeat to minutely expand and contract. Thus, similarly to the mid-recording micro-vibrating operation explained with reference to FIG. 3B, the meniscus 52 can be minutely vibrated between a position of a jetting side and a position of a contracting side nearer to the pressure chamber 36.

In order to supply the micro-vibrating signal to the piezoelectric vibrating members 35, printing datum DV for a micro-vibrating operation, which is "1" for all the nozzles 51, is set to the shift register 55. Then, the latch signal is applied, so that the set printing datum DV is latched to close (connect) the switching unit 58. In order to stop supplying the micro-vibrating signal to the piezoelectric vibrating members 35, printing datum DV' for a micro-vibrating-stopping operation, which is "0" for all the nozzles 51, is set to the shift register 55. Then, the set printing datum DV' is latched to open the switching unit 58.

Then, a scanning operation including a recording operation of the printer described above is explained in more detail. In the printer, the menisci 52 can minutely vibrate to prevent the viscosity of ink from increasing in cooperation with a main scanning of the recording head 8, i.e., in cooperation with the scanning operation for a line. In more detail, the menisci 52 can minutely vibrate: before the recording head 8 (carriage 21) is accelerated, while the recording head 8 is being accelerated, just before the recording operation is performed, while the recording operation is performed, while the recording head 8 is being decelerated, and after the recording head 8 has been decelerated.

Figure 7:
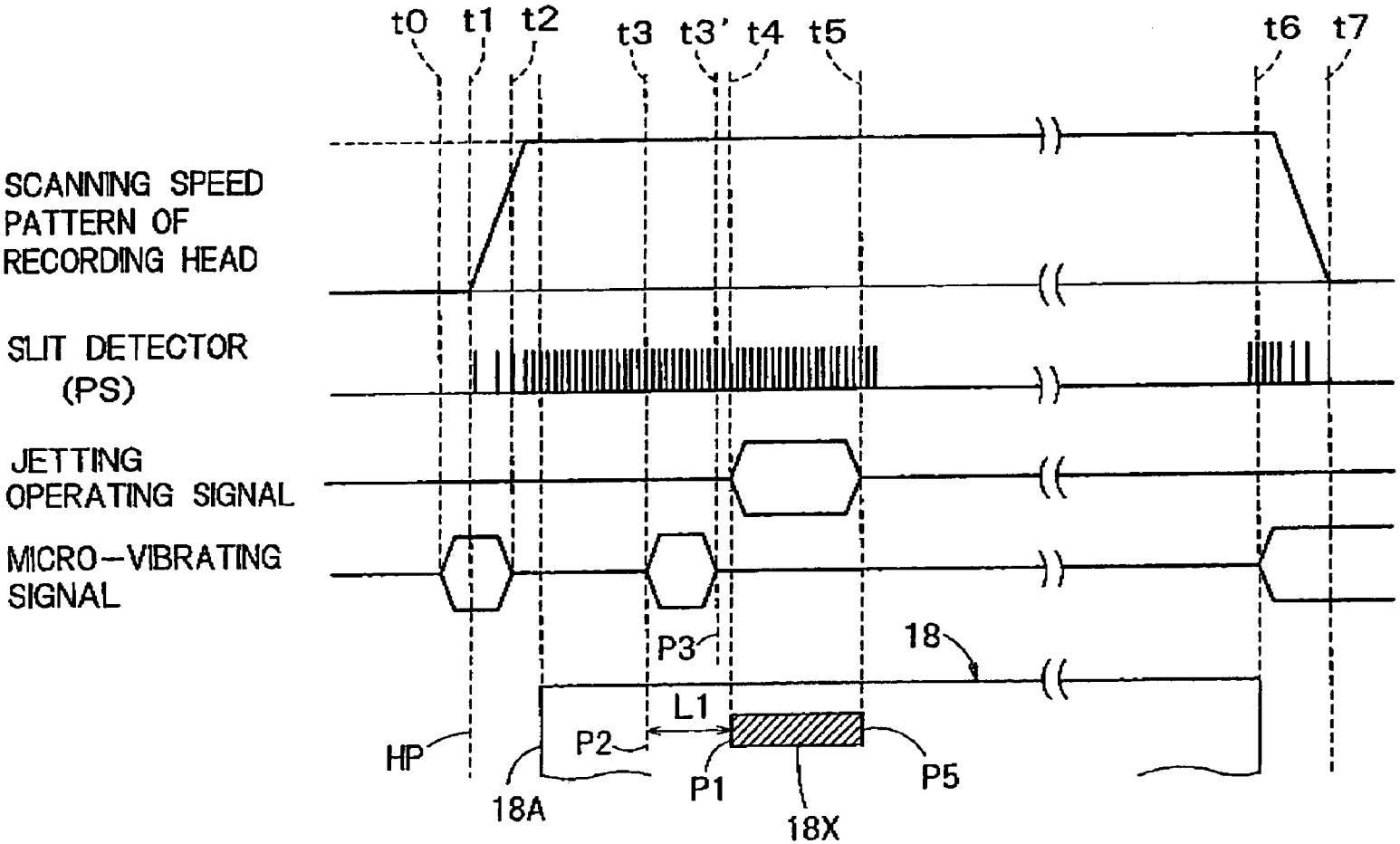
FIG. 7 is a timing chart for explaining a recording operation for a line.

As shown in FIG. 7, in the case, an image 18X is recorded in an area on a side of the home position HP in the recording paper 18, that is, in the former half of a line.

Figure 8:
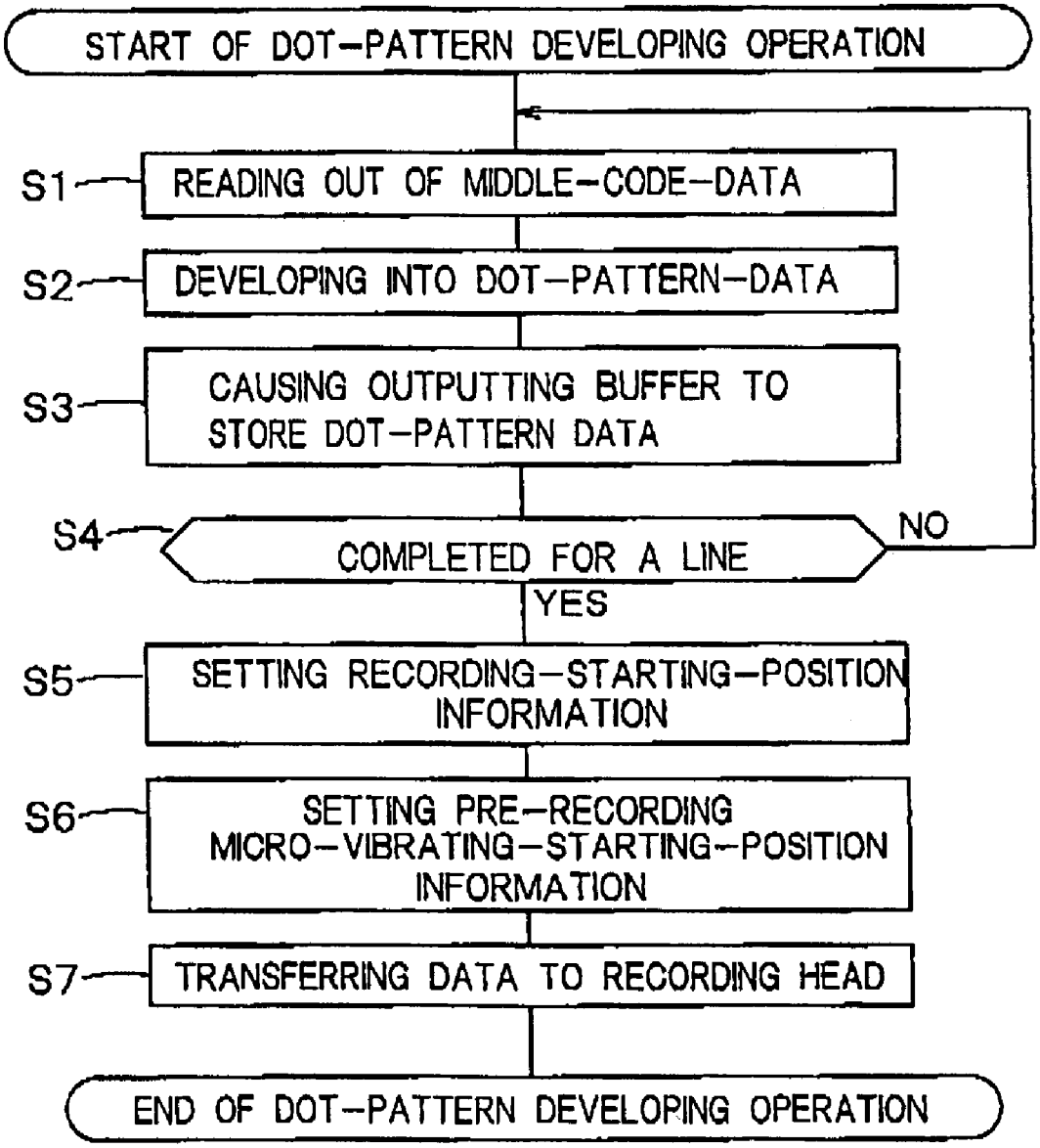
FIG. 8 is a flowchart for explaining a dot-pattern developing operation.
Figure 9A:
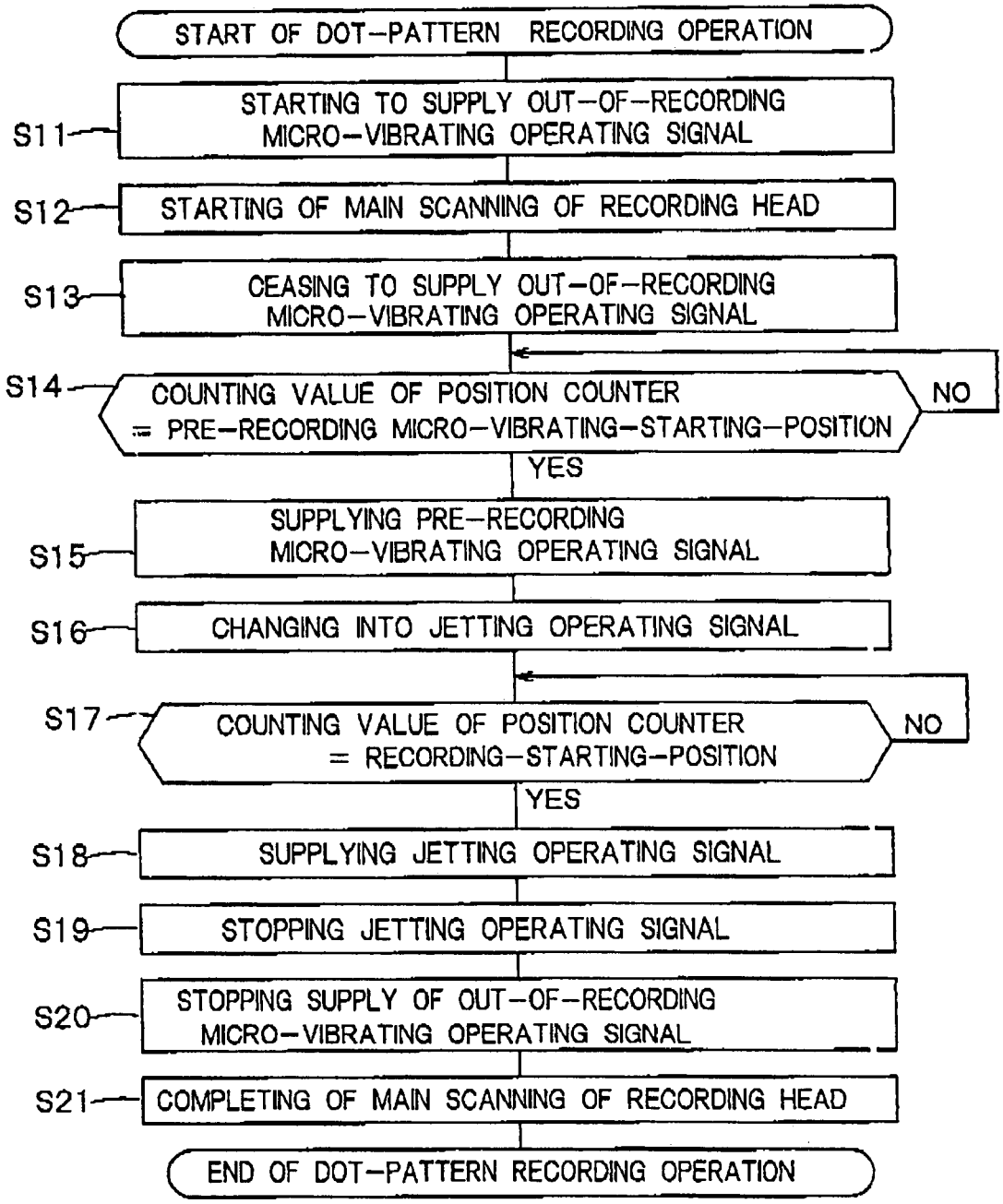
FIG. 9A is a flowchart for explaining a dot-pattern recording operation.
Figure 9B:
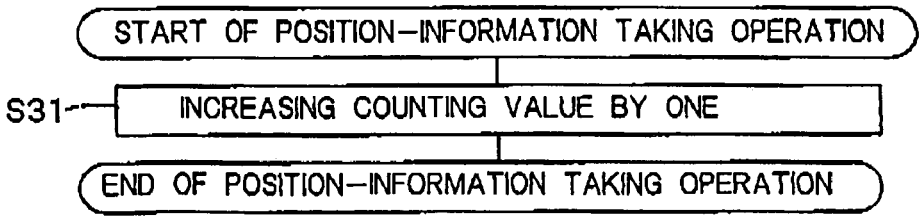
FIG. 9B is a flowchart for explaining a position-information taking operation.

FIG. 7 is a timing chart for explaining the scanning operation including the recording operation for the line. In FIG. 7, there are also shown the recording paper 18, and a relationship between a recording area by the recording head 8 and time. FIG. 8 is a flowchart for explaining a dot-pattern developing operation. FIG. 9A is a flowchart for explaining a dot-pattern recording operation. FIG. 9B is a flowchart for explaining a position-information taking operation that may be carried out interrupting the dot-pattern recording operation.

The recording operation is mainly divided into the dot-pattern developing operation for generating dot-pattern-data for the line from the middle-code-data, and the dot-pattern recording operation for recording (jetting ink) on the recording paper 18 based on the developed dot-pattern-data.

Each of the dot-pattern developing operation and the dot-pattern recording operation is explained as below.

In the dot-pattern developing operation shown in FIG. 8, the controlling part 6 functions as a dot-pattern-data generating unit to generate the dot-pattern-data for the line. That is, the controlling part 6 reads out middle-code-data stored in the middle buffer 4B (S1), develops the middle-code-data into a part of the dot-pattern-data based on the font data and the graphic functions or the like stored in the ROM 5 (S2), and causes the outputting buffer 4C to store the part of the developed dot-pattern-data (S3). Then, the developing operation is repeated until all the parts of the dot-pattern-data for the line are stored in the outputting buffer 4C (S4).

When the dot-pattern-data corresponding to the line are stored in the outputting buffer 4C, the controlling part 6 functions as a recording-starting-position-information setting unit to set recording-starting-position information that represents a position where a nozzle should start to record in the line, that is, where a first ink drop should be jetted from the nozzle during the main scanning (S5). In FIG. 7, the recording-starting-position is designated by a reference sign P1.

In the embodiment, the recording-starting-position information is set correspondingly to the counting value about the slits 28 of the linear encoder 27, that is, the counting value of pulses PS outputted from the slit detector 29.

Then, the controlling part 6 functions as a pre-recording-micro-vibrating-starting-position-information setting unit to set pre-recording-micro-vibrating-starting-position information that represents a position where the micro-vibrating unit should start to cause the ink to minutely vibrate, for example just before starting the recording operation (S6). For example, the pre-recording-micro-vibrating-starting-position is set at a position P2 back to the home position HP from the recording-starting-position P1 by a distance L1 that is necessary for the menisci to keep minutely vibrating and to settle down thereafter. That is, the setting of the pre-recording-micro-vibrating-starting-position P2 is carried out based on the recording-starting-position information that has been set previously. Then, a counting value obtained by subtracting a counting value corresponding to the distance L1 from a counting value corresponding to the recording-starting-position P1 is set as a counting value corresponding to the micro-vibrating-starting-position P2.

When the pre-recording-micro-vibrating-starting-position information is set, the controlling part 6 transfers the developed dot-pattern-data to the recording head 8 (S7). On transferring the developed dot-pattern-data, a scanning operation starts for the line, that is, the recording head 8 starts scanning in the main scanning direction. In addition, a micro-vibrating controlling operation that cause the menisci 52 to minutely vibrate to stir the ink in the nozzles 51 is carried out in cooperation with the main scanning of the recording head 8. During the micro-vibrating controlling operation, the controlling part 6 functions as a micro-vibrating controlling unit.

After transferring the dot-pattern-data, the controlling part 6 carries out the dot-pattern recording operation. In the dot-pattern recording operation, the controlling part 6 functions as an out-of-recording micro-vibrating controlling unit (one kind of the micro-vibrating controlling unit) to stir the ink. That is, on transferring the dot-pattern-data, the controlling part 6 supplies an out-of-recording micro-vibrating signal from the micro-vibrating-signal generating part 12 to the piezoelectric vibrating members 35 of the recording head 8.

Herein, the out-of-recording micro-vibrating operation is performed based on a predetermined out-of-recording micro-vibrating area. In this embodiment, the out-of-recording micro-vibrating area is set based on a recordable area with respect to the recording paper 18. In detail, the recordable area for the recording paper 18 is stored in a storing unit 100*m* (see FIG. 1) in, the printer controller 1, and an out-of-recording micro-vibrating-area setting unit 100 (see FIG. 1) is adapted to set the out-of-recording micro-vibrating areas both before and after the recordable area stored in the storing unit 100*m*.

As shown in FIG. 7, the out-of-recording micro-vibrating areas of this embodiment are an area to a timing t2 just before the recording head 8 is switched from an accelerated state to a constant-speed state (that is equal to an area to a position before a start end of the recordable area by a predetermined distance L1) and an area after a terminal end (timing t6) of the recordable area.

After transferring the dot-pattern-data, as shown in FIGS. 7 and 9A, the controlling part 6 starts to supply the out-of-recording micro-vibrating signal (S11, t0), and then starts the scanning of the recording head 8(S12, t1). In addition, as described below, if the main scanning is repeated successively, the out-of-recording micro-vibrating operation is continued in advance during transferring the dot-pattern-data. After that, the controlling part 6 ceases to supply the out-of-recording micro-vibrating signal at the timing t2 just before a speed of the recording head 8 ceases to increase but becomes constant (S13).

During the series of steps, the controlling part 6 outputs such a controlling signal to the choosing part 13 that the out-of-recording micro-vibrating signal from the micro-vibrating-signal generating part 12 is allowed to be supplied to the piezoelectric vibrating members 35. Then, the controlling part 6 sets the printing data DV for a micro-vibrating operation into the shift register 55, and outputs the latch signals to the latch circuit 56 to start supplying the out-of-recording micro-vibrating signal to the piezoelectric vibrating members 35 (see FIG. 6). Then, the controlling part 6 supplies an operating pulse to the pulse motor 25 to move the carriage 21 in the main scanning direction. Thus, the recording head 8 starts scanning. At the same time, the printing data DV' for a micro-vibrating-stopping operation is set into the shift register 55. After that, if the supply-stopping timing t2 of the out-of-recording micro-vibrating signal is judged, the latch signals are outputted.

During the scanning of the recording head 8, the slit detector 29 mounted on the carriage 21 detects the slits 28 of the linear encoder 27, and outputs pulse-like detecting signals that are shown with reference sign PS in FIG. 7. The controlling part 6 watches the detecting signals and carries out the position-information taking operation whenever each of the detecting signals is received. The position-information taking operation is carried out interrupting the dot-pattern recording operation. In the position-information operation, the position counter is updated (S31). In more detail, the counting value of the position counter that represents head-position information increases by one based on each of the detecting signals from the slit detector 29. After the counting value has increased by one, the dot-pattern recording operation is resumed. Herein, the counting value of the position counter may be reset when the scanning of the recording head 8 for the line is completed or when the recording head 8 is returned at the standard position.

During the scanning of the recording head 8, the controlling part 6 also functions as a pre-recording micro-vibrating-starting-timing judging unit, that is, judges a micro-vibrating-starting timing just before the recording operation (S14). In the embodiment, the controlling part 6 can judge the, pre-recording micro-vibrating-starting timing by comparing the counting value of the position counter with the counting value corresponding to the pre-recording micro-vibrating-starting-position P2 (micro-vibrating-starting-position information) because the controlling part 6 watches the counting value of the position counter (t3).

When the controlling part 6 judges that it is the pre-recording micro-vibrating-starting timing, the controlling part 6 functions as a pre-recording micro-vibrating controlling unit (one kind of the micro-vibrating controlling unit) to supply a pre-recording micro-vibrating signal to the piezoelectric vibrating members 35 (S15). That is, in the process, after the controlling part 6 sets the printing data DV for a micro-vibrating operation, into the shift register 55, the controlling part 6 outputs the latch signals to the latch circuit 56 to start supplying the pre-recording micro-vibrating signal from the micro-vibrating-signal generating part 12 to the piezoelectric vibrating members 35. While the pre-recording micro-vibrating signal is supplied, the controlling part 6 sets the printing data DV' for a micro-vibrating-stopping operation into the shift register 55. After that, if a predetermined supply-stopping timing (t3'), which is described below, is judged, the controlling part 6 outputs the latch signals to stop supplying the pre-recording micro-vibrating signal (see FIG. 6).

The predetermined stopping timing (t3') can be judged by using a timer for measuring a time (t3'–t3) for which the pre-recording micro-vibrating signal is being supplied. In the case, the predetermined stopping timing (t3') can be judged when the pre-recording micro-vibrating signal is supplied for the predetermined time (t3'–t3), that is, when the timer measures the predetermined time (t3'–t3). Alternatively, the predetermined stopping timing (t3') can be judged by comparing the counting value of the position counter with a predetermined counting value P3.

Then, after ceasing to supply the pre-recording micro-vibrating signal, the controlling part 6 outputs such a controlling signal to the choosing part 13 of the operating-signal generating part 9 that the jetting operating signal from the main signal generating part 11 is allowed to be supplied to the piezoelectric vibrating members 35 (S16).

After outputting the controlling signal, the controlling part 6 also functions as a recording-starting-timing judging unit (means), that is, judges a recording-starting timing (S17). In the embodiments, the controlling part 6 can judge the recording-starting timing by comparing the counting value of the position counter with the counting value corresponding to the recording starting-position P1 because the controlling part 6 watches the counting value of the position counter (t4).

When the controlling part 6 judges that it is the recording-starting timing, the controlling part 6 supplies the jetting operating signal to the piezoelectric vibrating members 35 to record (jet the ink) on the recording paper 18 (S18). In the case, as shown in FIG. 5, one of the small-dot operating pulse, the medium-dot operating pulse, the large-dot operating pulse and the mid-recording micro-vibrating signal is supplied to each of the piezoelectric vibrating members 35A to 35N, based on the dot-pattern-data. Then, the ink drop jetted from the nozzle forms a small dot, a medium dot or a large dot correspondingly to the supplied operating pulse.

In addition, the mid-recording micro-vibrating signal is supplied for a nozzle or nozzles 51 which do not jet ink, so that a meniscus or menisci of the ink in the nozzle or the nozzles 51 can minutely vibrate to stir the ink.

According to the above control, the ink drop can be jetted in a state wherein the viscosity of the ink is returned at a normal level by the micro-vibrating of the meniscus 52 just before the jetting. Thus, a first ink drop of a line can be jetted accurately in a predetermined direction. Therefore, the deterioration of the quality of the recorded (printed) image is effectively prevented especially at the position where the printing operation starts even when the volume of the jetted ink is so small that the viscosity of the ink is liable to increase.

In addition, when the recording paper is large-sized, the ink drop may not be jetted for such a longer time that the viscosity of the ink is liable to increase. However, even in the case, the above control can certainly prevent the deterioration of the quality of the printed image at the position where the printing operation starts.

When the scanning operation for the line is completed (timing t5 of FIG. 7), the supply of the operating pulses is also stopped (S19). Then, if the recording head 8 enters again the out-of-recording micro-vibrating area (timing t6), the controlling part 6 starts again to supply the out-of-recording micro-vibrating signal (S20). That is, the controlling part 6 outputs such a controlling signal to the choosing part 13 that the out-of-recording micro-vibrating signal from the micro-vibrating-signal generating part 12 is allowed to be supplied to the piezoelectric vibrating members 35. Then, the controlling part 6 sets the printing data DV for a micro-vibrating operation into the shift register 55, and outputs the latch signals to the latch circuit 56 to start supplying the out-of-recording micro-vibrating signal to the piezoelectric vibrating members 35 (see FIG. 6).

After that, the pulse motor 25 is decelerated, and then the recording head 8 is stopped (S21). Then, the recording head 8 is moved toward the home position HP, and is positioned at the standard position. Then, the similar scanning operation including the recording operation is repeated for the next line.

According to the above control, even after the ink drop or drops are jetted, the meniscus or menisci 52 can minutely vibrate to prevent the viscosity of the ink from increasing. Thus, even if one or more ink drops are jetted only in a former part of a line, it can be prevented that the viscosity of the ink increases. Thus, it can be prevented that the recording operation for the next line is badly influenced thereby. This effect may be remarkable when a large-sized recording paper is used.

Figure 10:
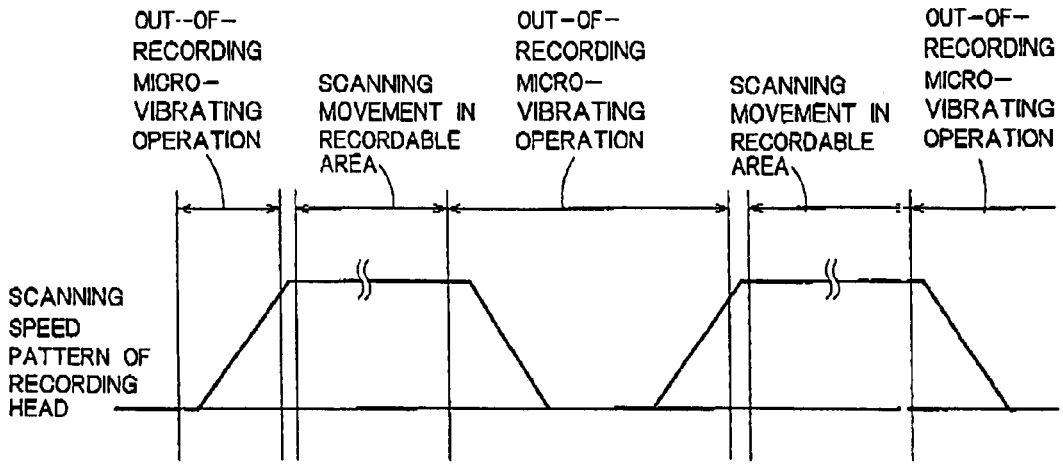
FIG. 10 is a timing chart for explaining out-of-jetting micro-vibrating areas for successive two main scanning operations.

In addition, if the recording operations (main scanning operations) are successively performed, it is preferable that the out-of-recording micro-vibrating operation is continuously performed. That is, it is preferable that the out-of-recording micro-vibrating operation is continuously performed from the timing t6 of a recording operation until the timing t2 of the next recording operation. FIG. 10 shows such an example.

Figure 11:
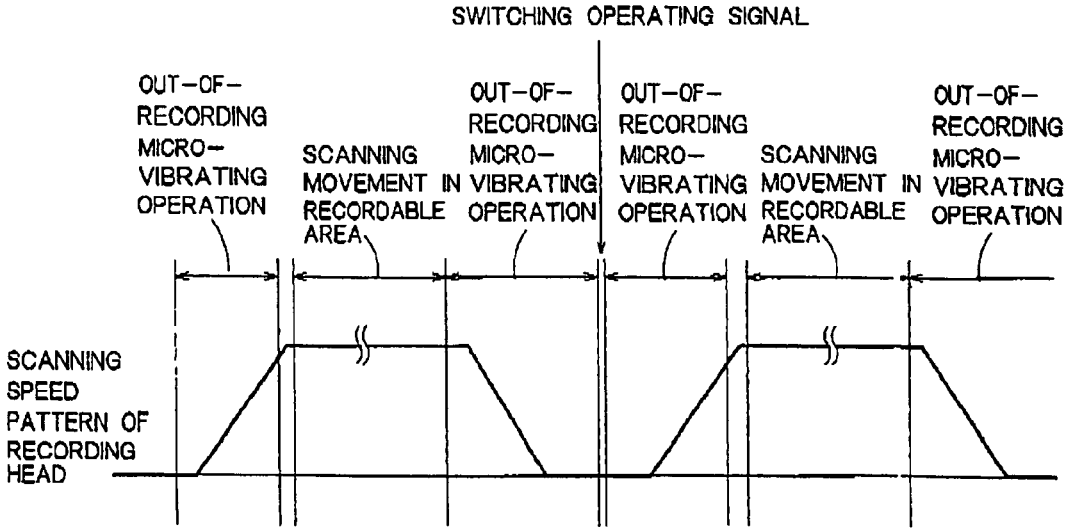
FIG. 11 is a timing chart for explaining out-of-jetting micro-vibrating areas for successive forward and backward main scanning operations.

Furthermore, if the apparatus can achieve two-way recording (BI-D type), the operating signal used during a forward scanning and the operating signal used during a backward scanning may be different. Thus, preferably, a signal-switching operation is conducted when the scanning direction of the recording head 8 is switched. During the signal-switching operation, the out-of-recording micro-vibrating operation is suspended for a time necessary to transfer waveforms. FIG. 11 shows such an example.

In the above embodiment, the menisci 52 can minutely vibrate to stir the ink before the carriage 21 is accelerated and while the carriage 21 is being accelerated (out-of-recording) and for a predetermined time just before the recording operation (pre-recording). However, the pre-recording micro-vibrating just before the recording operation may be carried out only when the recording operation starts at a position in a predetermined area, for example in the latter half of a line. That is, the controlling part 6 (micro-vibrating controlling unit) may carry out the pre-recording micro-vibrating operation only when a recording-starting position represented by the recording-starting-position information is in the right (latter) area with respect to a predetermined position. In the case as well, the viscosity of the ink is sufficiently prevented from increasing, because the ink may be sufficiently stirred by only the out-of-recording micro-vibrating operation (micro-vibrating operation during the accelerating time) when the recording operation starts at a position in the left (former) area with respect to the predetermined position.

In addition, as a variation of the above embodiment, the pre-recording micro-vibrating operation just before the recording operation can be completely omitted.

Herein, according to the above embodiment, compared with the conventional art, the out-of-recording (out-of-jetting) micro-vibrating operation(s) is performed for a longer time. This may arise a problem of deterioration of the piezoelectric vibrating members 35 that are the micro-vibrating unit.

Therefore, as shown in FIG. 1, in the ink-jetting recording apparatus of the embodiment, a standard-time storing part 110 that stores a predetermined standard time and a micro-vibrating timer 111 that can measure a continuous operating time of the out-of-recording micro-vibrating operation are provided. If the continuous operating time becomes longer than the standard time, the controlling part 6 as a signal-generating controlling unit is adapted to cause the micro-vibrating-signal generating part 12 to change the out-of-recording micro-vibrating signal.

In the case, based on the continuous operating time of the out-of-recording micro-vibrating operation, for example, strength of the out-of-recording micro-vibrating operation can be controlled, in order to prevent the deterioration of the piezoelectric vibrating members 35.

For example the controlling part 6 as a signal-generating controlling unit is adapted to cause the micro-vibrating-signal generating part 12 to change the out-of-recording micro-vibrating signal in such a manner that a frequency of the out-of-recording micro-vibrating signal is lowered when the continuous operating time becomes longer than the standard time. For example, an original frequency of 10.8 kHz may be lowered to 2.7 kHz. Alternatively, the controlling part 6 is adapted to cause the micro-vibrating-signal generating part 12 to change the out-of-recording micro-vibrating signal in such a manner that an amplitude of the out-of-recording micro-vibrating signal is lowered when the continuous operating time becomes longer than the standard time.

In addition, after the frequency of the out-of-recording micro-vibrating signal has been lowered by the micro-vibrating-signal generating part 12, the controlling part 6 that serves as the signal-generating controlling unit is adapted to cause the micro-vibrating-signal generating part 12 to change again the out-of-recording micro-vibrating signal before a recording (liquid-jetting) operation in such a manner that the frequency of the out-of-recording micro-vibrating signal is returned to an original frequency. In addition, after the frequency of the out-of-recording micro-vibrating signal has been returned to the original frequency, the micro-vibrating unit is caused to operate (the out-of-recording micro-vibrating operation is performed) based on the out-of-recording micro-vibrating signal for a predetermined time before the liquid-jetting operation (before starting the actual recording operation). According to the above control, deterioration of quality of the recorded (printed) image is more surely prevented even at the position where the recording operation starts, while deterioration of the piezoelectric vibrating members 35 is also prevented.

Similarly, after the amplitude of the out-of-recording micro-vibrating signal has been lowered by the micro-vibrating-signal generating part 12, the controlling part 6 that serves as the signal-generating controlling unit is adapted to cause the micro-vibrating-signal generating part 12 to change again the out-of-recording micro-vibrating signal before a recording (liquid-jetting) operation in such a manner that the amplitude of the out-of-recording micro-vibrating signal is returned to an original amplitude. In addition, after the amplitude of the out-of-recording micro-vibrating signal has been returned to the original amplitude, the micro-vibrating unit is caused to operate (the out-of-recording micro-vibrating operation is performed) based on the out-of-recording micro-vibrating signal for a predetermined time before the liquid-jetting operation (before starting the actual recording operation). According to the above control, deterioration of quality of the recorded (printed) image is more surely prevented even at the position where the recording operation starts, while deterioration of the piezoelectric vibrating members 35 is also prevented.

In addition, in the above embodiment, the controlling part 6 that serves as an out-of-jetting micro-vibrating controlling unit is adapted to cause the micro-vibrating unit to operate during at least a part of time for which the capping mechanism 30 seals the nozzles 51.

In detail, while the capping mechanism 30 seals the nozzles 51, an intermittent micro-vibrating controlling step of driving the piezoelectric vibrating members 35 for a first constant time (for example 4 or 5 minutes) and of stopping driving the piezoelectric vibrating members 35 for a second constant time (for example 4 or 5 minutes) is repeated.

In the case, a history recording unit 120 that records history information about ink-jetting operations is provided (see FIG. 1). The controlling part 6 serves as a time-changing unit, that is, the controlling part 6 can change at least one of the first constant time and the second constant time, based on the history information about ink-jetting operations recorded by the history recording unit 120. Preferably, in advance, a proper relationship between the history information about ink-jetting operations and the first constant time and the second constant time is obtained by various measurement experiments or the like, and is stored in the RAM 4 or the like in a manner such as a correspondence table or a correspondence equation.

Furthermore, in the case, an environmental-information obtaining unit 130 that can obtain environmental information (temperature, humidity or the like) around the capping mechanism 30 is provided (see FIG. 1). The controlling part 6 that serves as a time-changing unit can also change at least one of the first constant time and the second constant time, based on the environmental information obtained by the environmental-information obtaining unit 130 as well. Preferably, in advance, a proper relationship between the environmental-information and the first constant time and the second constant time is obtained by various measurement experiments or the like, and is stored in the RAM 4 or the like in a manner such as a correspondence table or a correspondence equation.

In addition, while the capping mechanism 30 seals the nozzles 51, in order to prevent the deterioration of the piezoelectric vibrating members 35, the controlling part 6 as a signal-generating controlling unit is-adapted to cause the micro-vibrating-signal generating part 12 to change the out-of-recording micro-vibrating signal in such a manner that a frequency of the out-of-recording micro-vibrating signal is lowered. For example, an original frequency of 10.8 kHz may be lowered to 2.7 kHz. Alternatively, the controlling part 6 is adapted to cause the micro-vibrating-signal generating part 12 to change the out-of-recording micro-vibrating signal in such a manner that amplitude of the out-of-recording micro-vibrating signal is lowered.

Furthermore, it may be preferable that the out-of-recording micro-vibrating operation is not performed (the out-of-recording micro-vibrating areas don't include) during a capping step, during a CL(cleaning)-sequence step, during an ink-cartridge replacing step, during a shifting step to each of said steps, during a flushing step or the like, dependently on use condition of the ink-jet recording apparatus or the like.

In the above embodiment, the printer includes the recording head 8 having the bending-mode piezoelectric vibrating members 35. However, the printer may include a recording head 70 having a longitudinal-mode piezoelectric vibrating unit 73, instead of the recording head 8.

Figure 12:
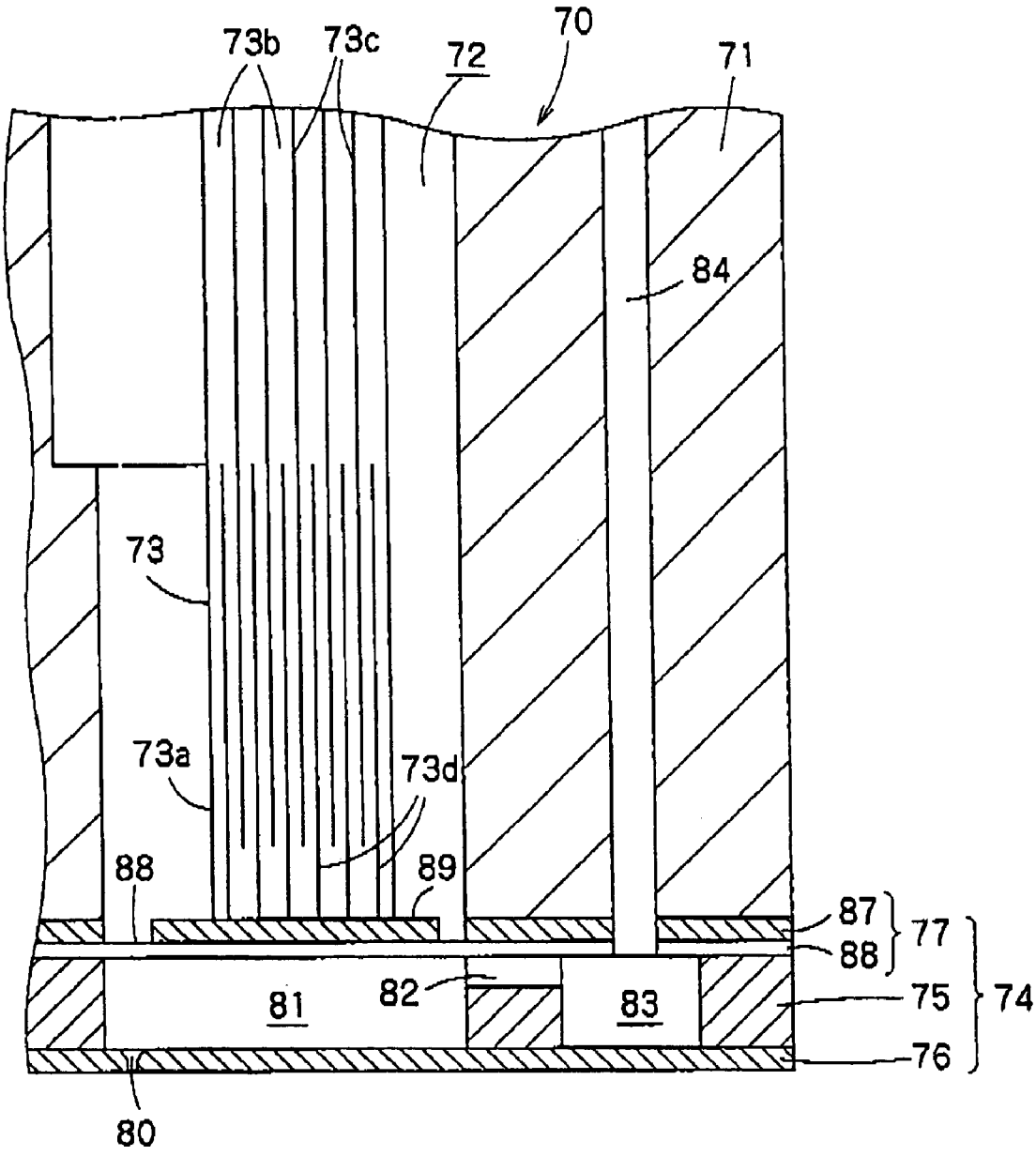
FIG. 12 is a sectional view of a recording head using a longitudinal-mode piezoelectric vibrating member.

As shown in FIG. 12, the recording head 70 has a plastic box-like case 71 defining a housing room 72. The longitudinal-mode piezoelectric vibrating unit 73 has a shape of teeth of a comb, and is inserted in the housing room 72 in such a manner that points of teeth-like portions 73*a* of the piezoelectric vibrating unit 73 are aligned at an opening of the housing room 72. A ink-way unit 74 is bonded on a surface of the case 71 on the side of the opening of the housing room 72. The points of the teeth-like portions 73*a* are fixed at predetermined positions of the ink-way unit 74 to function as piezoelectric vibrating members respectively.

The piezoelectric vibrating unit 73 comprises a plurality of piezoelectric layers 73*b*. As shown in FIG. 10, common inside electrodes 73*c* and individual inside electrodes 73*d* are inserted alternately between each adjacent two of the piezoelectric layers 73*b*. The piezoelectric layers 73*b*, the common inside electrodes 73*c* and the individual inside electrodes 73*d* are integrated and cut into the shape of the teeth of the comb. Thus, when a voltage is provided between the common inside electrodes 73*c* and an individual inside electrode 73*d*, a piezoelectric vibrating member contracts in a longitudinal direction of each of the piezoelectric layers 73*b*.

The ink-way unit 74 consists of a nozzle plate 76, an elastic plate 77 and an ink-way forming plate 75 sandwiched between the nozzle plate 76 and the elastic plate 77. The nozzle plate 76, the ink-way forming plate 75 and the elastic plate 77 are integrated as shown in FIG. 10.

A plurality of nozzles 80 is formed in the nozzle plate 76. A plurality of pressure generating chambers 81, a plurality of ink-supplying ways 82 and a common ink-chamber 83 are formed in the ink-way forming plate 75. Each of the pressure chambers 81 is defined by partition walls, and is communicated with a corresponding nozzle 80 at an end portion thereof and with a corresponding ink-supplying way 82 at the other end portion thereof. The common ink-chamber 83 is communicated with all the ink-supplying ways 82, and has a longitudinal shape. For example, the longitudinal common ink-chamber 83 may be formed by an etching process when the ink-way forming plate 75 is a silicon wafer. Then, the pressure chambers 81 are formed in the longitudinal direction of the common ink-chamber 83 at the same intervals (pitches) as nozzles 80. Then, a groove as a ink-supplying way 82 is formed between each of the pressure chambers 81 and the common ink-chamber 83. In the case, the ink-supplying way 82 is connected to an end of the pressure chamber 81, while the nozzle 80 is located near the other end of the pressure chamber 81. The common ink-chamber 83 is adapted to supply ink saved in an ink cartridge to the pressure chambers 81. An ink-supplying tube 84 from the ink cartridge is communicated with a middle portion of the common ink-chamber 83.

The elastic plate 77 is layered on a surface of the ink-way forming plate 75 opposed to the nozzle plate 76. In the case, the elastic plate 77 consists of two laminated layers that are a stainless plate 87 and an elastic high-polymer film 88 such as a PPS film. The stainless plate 77 is provided with island portions 89 for fixing the teeth-like portions 73*a* as the piezoelectric vibrating members 73 in respective portions corresponding to the pressure chambers 81, by an etching process.

In the above recording head 70, a teeth-like portion 73*a* as a piezoelectric vibrating member can expand in the longitudinal direction. Then, an island portion 89 is pressed toward the nozzle plate 76, the elastic film 88 is deformed. Thus, a corresponding pressure chamber 81 contracts. On the other hand, the teeth-like portion 73*a* as the piezoelectric vibrating member can contract from the expanding state in the longitudinal direction. Then, the elastic film 88 is returned to the original state owing to elasticity thereof. Thus, the corresponding pressure chamber 81 expands. By causing the pressure chamber 81 to expand and then causing the pressure chamber 81 to contract, a pressure of the ink in the pressure chamber 81 increases so that the ink drop is jetted from a nozzle 80.

In the recording head 70 as well, the menisci can minutely vibrate in such a manner that the ink drop may not be jetted, in order to stir the ink in the nozzles, by expanding and contracting of the piezoelectric vibrating members.

By the way, in the embodiment, the scanning-position-information outputting-information unit consists of the linear encoder 27 and the slit detector 29. In addition, the recording-starting-position-information setting unit, the micro-vibrating-starting-position-information setting unit and the micro-vibrating-starting-timing judging unit are adapted to set or judge the recording-starting-position information, the micro-vibrating-starting-position information and the micro-vibrating-starting-timing by means of the counting value corresponding to the detecting signals outputted from the slit detector 29. In the case, the scanning position of the recording head B may be surely obtained.

However, this invention can adopt another scanning-position-information outputting unit. For example, if a pattern of the scanning speed of the recording head 8 is fixed regardless of the dot-pattern-data, that is, if the recording head 8 is moved by the same scanning speed pattern, the scanning position of the recording head 8 can be obtained indirectly from a time passed from when the recording head has started scanning.

In the case, the scanning-position-information outputting unit may consist of a scanning-time timer 101 (first-scanning-time timer) for measuring a time passed from a scanning-starting timing (t1). The scanning position of the recording head 8 can be obtained from a timer value of the scanning-time timer 101, because the timer value corresponds to the head-position information.

In the case, the recording-starting-position-information setting unit may set a timer value for the recording-starting-position, that corresponds to the recording-starting-position information. Similarly, the micro-vibrating-starting-position-information setting unit may set a timer value for the micro-vibrating-starting-position, that corresponds to the micro-vibrating-starting-position information.

The micro-vibrating-starting-timing judging unit judges the micro-vibrating-starting timing by comparing the timer value of the scanning-time timer 101 with the timer value for the micro-vibrating-starting-position. Similarly, the recording-starting-timing judging unit judges the record-starting timing by comparing the timer value of the scanning-time timer 101 with the timer value for the recording-starting-position.

As described above, when the scanning position of the recording head 8 can be obtained from the timer value of the scanning-time timer 101, it is not necessary to provide with the linear encoder 27 and the slit detector 29. Thus, the apparatus may become simpler. In addition, the controlling part 6 does not have to watch the detecting signals from the slit detector 29. Thus, the controlling manner may also become simpler, and the processing speed may become faster.

The scanning-time timer 101 is adapted to measure a time passed from when the recording head 8 has started scanning. However, another scanning-time timer 102 (a second-scanning-time timer) can measure a time passed from when the scanning speed of the recording head 8 has become constant. In the case, a standard-passing position is set at a position where the scanning speed of the recording head 8 should become constant, for example at an end position 18A (see FIG. 7) of the recording paper 18 on the side of the home position HP in the width direction in addition, there is provided a passing sensor that can detect a passing of the recording head 8 above the standard-passing position. Then, the scanning-time timer 102 starts to measure the time based on a detecting signal of the passing sensor. In the case, since the scanning-time timer 102 starts to measure the time passed from when the scanning speed of the recording head 8 has become constant, the scanning position of the recording head 8 can be obtained more accurately.

However, the scanning-position-information outputting unit is not limited to the combination of the linear encoder 27 and the slit detector 29, the scanning-time timer 101, and the scanning-time timer 102. Any scanning-position-information outputting unit capable of outputting information that represents the scanning position of the recording head 8 may be adopted.

For example, when the carriage 21 is reciprocated in the main scanning direction by a ball-spline mechanism, a rotary encoder may be attached to a rotating shaft of the ball-spline mechanism in such a manner that the rotary encoder rotates together with the rotating shaft and a slit detector may be provided for detecting slits of the rotary encoder. In the case, the recording-starting-position and the micro-vibrating-starting-position can be recognized from detecting signals from the slit detector.

In the embodiment, the controlling part 6 functioning as a micro-vibrating controlling unit is adapted to supply the operating signal generated by the operating-signal generating part 9 (the main signal generating part 11 and the micro-vibrating-signal generating part 12) to the recording head 8. However, another micro-vibrating controlling unit can be adopted.

In the embodiment, the recording-starting-position-information setting unit is adapted to set the recording-starting-position of the recording head 8 based on the dot-pattern data. However, data for setting the recording-starting-position are not limited to the dot-pattern-data. For example, the recording-starting-position may be set based on printing data (one kind of recording data) from the host computer, or based on intermediate data (one kind of recording data).

In the embodiment, the printer includes the recording head 8 having the pressure chambers 36 that can expand and contract by means of the piezoelectric vibrating members 35. However, this invention can also apply to a printer or a plotter including a bubble-jet recording head that can jet ink drop from a nozzle by changing a size of air bubble generated in a pressure chamber.

Figure 13:
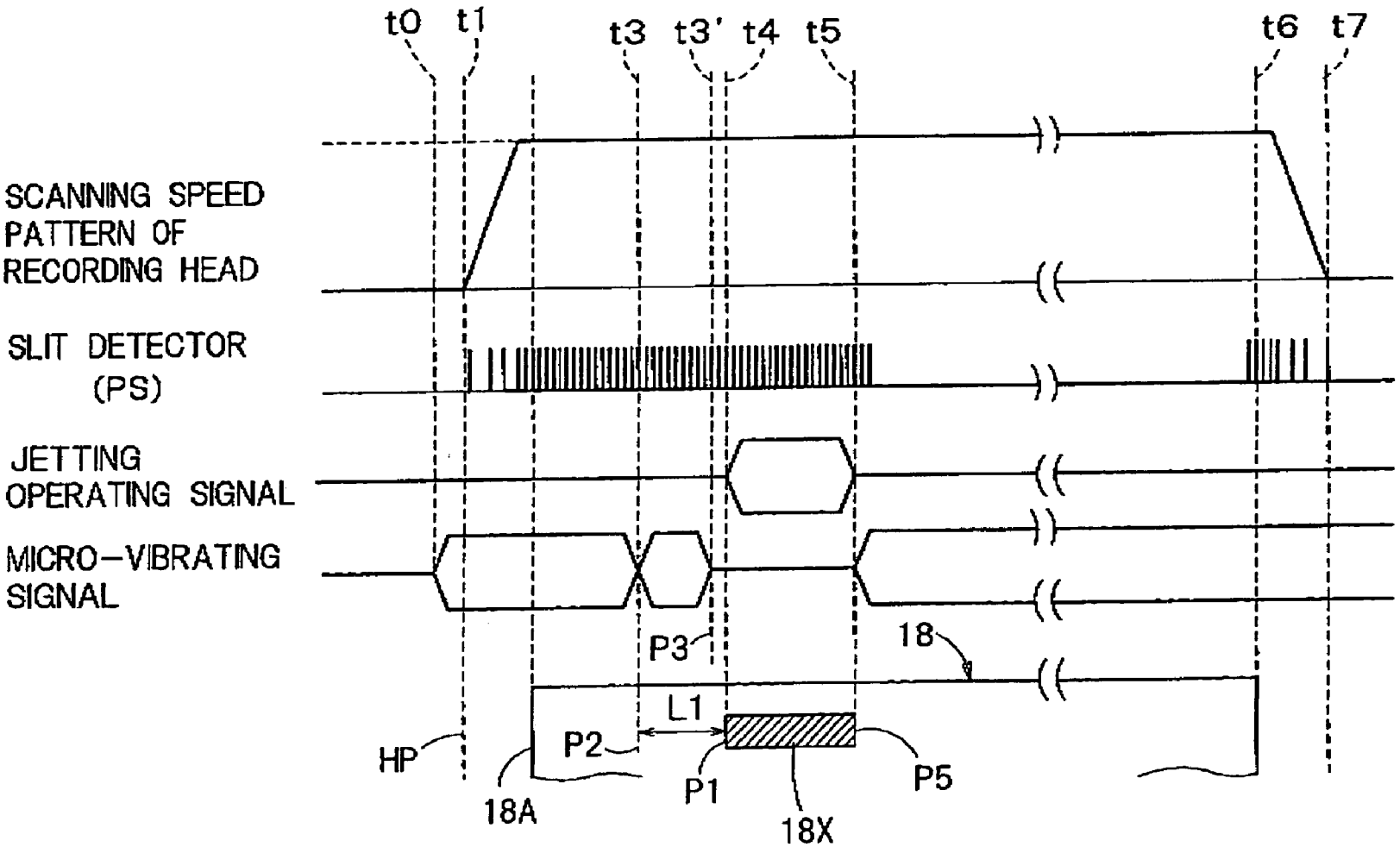
FIG. 13 is another timing chart for explaining a recording operation for a line.

FIG. 13 is another timing chart for explaining a scanning operation including a recording operation for a line. As shown in FIG. 13, the controlling part 6 functions as a recording-starting-position information setting unit to set recording-starting-position information that represents a position in a line where the recording operation is to be started and as a recording-ceasing-position-information setting unit to set recording-ceasing-position information that represents a position in the line where the recording operation is to be stopped i.e. where the last ink drop is jetted in the line in the main scanning direction. In the example shown in FIG. 13, the recording-starting position is represented by a reference sign P1, and the recording-ceasing position is represented by a reference sign P5.

Herein, similarly to the recording-starting-position information, the recording-ceasing-position information is also set correspondingly to the counting value about the slits 28 of the linear encoder 27, that is, the counting value of pulses PS outputted from the slit detector 29.

Then, the out-of-recording micro-vibrating areas in FIG. 13 are set before and after each ink-jetting area for each scanning operation, based, on not the recordable area of the recording paper 18 but each recording data for each scanning operation. That is, the out-of-recording micro-vibrating areas in FIG. 13 are an area until the timing t3 at which the pre-recording micro-vibrating operation is to be started and an area after the recording-ceasing position (timing t5).

Other features of the timing chart shown in FIG. 13 are substantially the same as the timing chart shown in FIG. 7.

As described above, according to the timing chart shown in FIG. 13, the menisci of the ink in the nozzles can be caused to minutely vibrate continuously until a suitable timing (t3') just before an ink drop is jetted from a nozzle. To cause the menisci to keep minutely vibrating until the suitable timing is very effective when the ink is a kind of pigment ink or a kind of high-density-dye ink whose viscosity is liable to increase.

In addition, according to the timing chart shown in FIG. 13, the menisci of the ink in the nozzles can be caused to minutely vibrate continuously from a timing (t5) just after the last ink drop has been jetted from a nozzle. To cause the menisci to keep minutely vibrating from the timing just after the completion of the recording operation is very effective when the ink is a kind of pigment ink or a kind of high-density-dye ink whose viscosity is liable to increase.

Furthermore, the pre-recording micro-vibrating operation can be omitted in the timing chart shown in FIG. 13 as well. Alternatively, the out-of-recording micro-vibrating operation before the ink-jetting may be performed until the timing t3' or the timing t4.

In the embodiment, the recording-starting-position of the recording head 8 means a position where one of the nozzles of the recording head 8 starts to record, i.e., jet the ink for a line. The recording-ceasing-position of the recording head 8 means a position where all of the nozzles of the recording head 8 complete recording for that line. However, in general, the nozzles start to record at different positions respectively, and complete recording at different positions respectively. Thus, it is preferable to take into consideration respective recording-starting-positions and respective recording-ceasing-positions of the nozzles.

That is, preferably, the nozzles are classified into at least two classes, the controlling part 6 functioning as a recording-starting-position setting unit and a recording-ceasing-position setting unit is adapted to set recording-starting-position information that represents positions where a nozzle or nozzles of the respective classes should start to record and recording-ceasing-position information, that represents positions where a nozzle or nozzles of the respective classes should complete recording. Then, the controlling part 6 functioning as a micro-vibrating controlling unit may judge respective micro-vibrating-starting timings set for the nozzle or the nozzles of the respective classes in order to cause the micro-vibrating unit to operate. The micro-vibrating unit may cause ink in the nozzle or nozzles of the respective classes to minutely vibrate.

In the case, when the class may includes a plurality of nozzles, ink in the nozzles of the class has preferably a velocity of increasing viscosity. Alternatively, when the class may includes a plurality of nozzles, ink in the nozzles of the class has a color. Alternatively, when the class may includes a plurality of nozzles, the nozzles of the class are arranged in a row. Alternatively, the class includes only one nozzle.

A program for materializing the above element or elements (unit or units) in the computer system, and a storage unit 201 storing the program and capable of being read by a computer, are intended to be protected by this application. When the above element or elements may be materialized in the computer system by using a general program such as an OS, a program including a command or commands for controlling the general program, and a storage unit 202 storing the program and capable of being read by a computer, are also intended to be protected by this application.

The above description is given for the ink-jetting printer 1 as a liquid jetting apparatus of an embodiment according to the invention. However, this invention is intended to apply to general liquid jetting apparatuses widely. For example, the liquid jetting apparatus may be a manufacturing unit for color filters of a display apparatus such as LCD. A liquid may be glue, nail polish, a bonding agent, a hardened coating liquid, an electric conductive liquid or the like, instead of the ink.

As described above, according to a feature of the invention, since the out-of-jetting micro-vibrating areas are set before and after the relative area (that may be common for lines) to which liquid can be jetted from the nozzle, it can be effectively prevented that a viscosity of the liquid increases between a completion of a scanning operation and a start of a next scanning operation.

Alternatively, according to another feature of the invention, since the out-of-jetting micro-vibrating areas are set before and after the liquid-jetting area (that may be different for respective lines) to which liquid is to be jetted from the nozzle while the head member is caused to relatively move by the scanning mechanism based on jetting data, it can be effectively prevented that a viscosity of the liquid increases between a completion of a scanning operation and a start of a next scanning operation.

What is claimed is:

1. A liquid jetting apparatus comprising;

a head member having a nozzle, a scanning mechanism that can cause the head member to relatively move with respect to the medium, a liquid jetting unit that can jet liquid from the nozzle, an out-of-jetting micro-vibrating-area setting unit that can set out-of-jetting micro-vibrating areas before and after a liquid-jetting area to which liquid is to be jetted from the nozzle while the head member is caused to relatively move by the scanning mechanism, a micro-vibrating unit that can cause liquid in the nozzle to minutely vibrate, an out-of-jetting micro-vibrating controlling unit that can cause the micro-vibrating unit to operate when the head member is located in the out-of-jetting micro-vibrating areas, and a signal generating unit that can generate an out-of-jetting micro-vibrating signal as a periodical signal having a predetermined waveform, wherein:

the out-of-jetting micro-vibrating controlling unit is adapted to cause the micro-vibrating unit to operate based on the out-of-jetting micro-vibrating signal, a measuring unit that can measure a continuous operating time of the micro-vibrating unit by the out-of-jetting micro-vibrating controlling unit is provided, a standard-time storing unit that stores a predetermined standard time is provided, and a signal-generating controlling unit that can compare the continuous operating time and the standard time, and that can cause the signal generating unit to change the out-of-jetting micro-vibrating signal based on result of the comparison is provided.

2. A liquid jetting apparatus according to claim 1, wherein:

the signal-generating controlling unit is adapted to cause the signal generating unit to change the out-of-jetting micro-vibrating signal in such a manner that a frequency of the out-of-jetting micro-vibrating signal is lowered when the continuous operating time becomes longer than the standard time.

3. A liquid jetting apparatus according to claim 2, wherein:

after the frequency of the out-of-jetting micro-vibrating signal has been lowered by the signal generating unit, the signal-generating controlling unit is adapted to cause the signal generating unit to change again the out-of-jetting micro-vibrating signal before a liquid-jetting operation in such a manner that the frequency of the out-of-jetting micro-vibrating signal is returned to an original frequency.

4. A liquid jetting apparatus according to claim 3, wherein:

after the frequency of the out-of-jetting micro-vibrating signal has been returned to the original frequency by the signal generating unit, the out-of-jetting micro-vibrating controlling unit is adapted to cause the micro-vibrating unit to operate based on the out-of-jetting micro-vibrating signal for a predetermined time before the liquid-jetting operation.

5. A liquid jetting apparatus according to claim 1, wherein:

the signal-generating controlling unit is adapted to cause the signal generating unit to change the out-of-jetting micro-vibrating signal in such a manner that an amplitude of the out-of-jetting micro-vibrating signal is lowered when the continuous operating time becomes longer than the standard time.

6. A liquid jetting apparatus according to claim 5, wherein:

after the amplitude of the out-of-jetting micro-vibrating signal has been lowered by the signal generating unit, the signal-generating controlling unit is adapted to cause the signal generating unit to change again the out-of-jetting micro-vibrating signal before a liquid-jetting operation in such a manner that the amplitude of the out-of-jetting micro-vibrating signal is returned to an original amplitude.

7. A liquid jetting apparatus according to claim 6, wherein:

after the amplitude of the out-of-jetting micro-vibrating signal is returned to the original amplitude by the signal generating unit, the out-of-jetting micro-vibrating controlling unit is adapted to cause the micro-vibrating unit to operate based on the out-of-jetting micro-vibrating signal for a predetermined time before the liquid-jetting operation.

8. A controlling unit for controlling a liquid jetting apparatus comprising:

a head member having a nozzle, a scanning mechanism that can cause the head member to relatively move with respect to the medium, a liquid jetting unit that can jet liquid from the nozzle, and a micro-vibrating unit that can cause liquid in the nozzle to minutely vibrate; the controlling unit comprising:

an out-of-jetting micro-vibrating-area setting unit that can set out-of-jetting micro-vibrating areas before and after a liquid-jetting area to which liquid is to be jetted from the nozzle while the head member is caused to relatively move by the scanning mechanism, an out-of-jetting micro-vibrating controlling unit that can cause the micro-vibrating unit to operate when the head member is located in the out-of-jetting micro-vibrating areas, and a signal generating unit that can generate an out-of-jetting micro-vibrating signal as a periodical signal having a predetermined waveform, wherein:

the out-of-jetting micro-vibrating controlling unit is adapted to cause the micro-vibrating unit to operate based on the out-of-jetting micro-vibrating signal, a measuring unit that can measure a continuous operating time of the micro-vibrating unit by the out-of-jetting micro-vibrating controlling unit is provided, a standard-time storing unit that stores a predetermined standard time is provided, and a signal-generating controlling unit that can compare the continuous operating time and the standard time, and that can cause the signal generating unit to change the out-of-jetting micro-vibrating signal based on result of the comparison is provided.

* * * * *